US009126065B2

(12) United States Patent
Uchida et al.

(10) Patent No.: US 9,126,065 B2
(45) Date of Patent: Sep. 8, 2015

(54) AIRBAG DEVICE FOR THE BODY

(75) Inventors: Mitsuya Uchida, Tokyo (JP); Osamu Tanaka, Kanagawa (JP); Kiyoshi Fukaya, Tokyo (JP); Takumi Yoshimura, Tokyo (JP); Toshiyo Tamura, Chiba (JP); Yukitoshi Takahashi, Shizuoka (JP)

(73) Assignee: PROP CO., LTD., Tokyo (JP)

( * ) Notice: Subject to any disclaimer, the term of this patent is extended or adjusted under 35 U.S.C. 154(b) by 1006 days.

(21) Appl. No.: 13/148,449

(22) PCT Filed: Feb. 8, 2010

(86) PCT No.: PCT/JP2010/051805

§ 371 (c)(1),
(2), (4) Date: Feb. 10, 2012

(87) PCT Pub. No.: WO2010/090317

PCT Pub. Date: Aug. 12, 2010

(65) Prior Publication Data

US 2012/0131718 A1 May 31, 2012

(30) Foreign Application Priority Data

Feb. 9, 2009 (JP) ..... 2009-027147

(51) Int. Cl.

| | |
|---|---|
| ***A41D 1/02*** | (2006.01) |
| ***A62B 99/00*** | (2009.01) |
| ***A41D 13/018*** | (2006.01) |

(52) U.S. Cl.

CPC ..... *A62B 99/00* (2013.01); *A41D 13/018* (2013.01)

(58) Field of Classification Search

USPC ..... 2/69, 108, 455, DIG. 3, 456; 280/728.1, 280/730.1, 733; 441/88, 90, 92, 96

See application file for complete search history.

(56) References Cited

U.S. PATENT DOCUMENTS

| | | | | |
|---|---|---|---|---|
| 5,500,952 | A * | 3/1996 | Keyes | 2/465 |
| 5,572,737 | A * | 11/1996 | Valice | 2/465 |
| 6,859,939 | B1 * | 3/2005 | Osburn, Sr. | 2/69 |

(Continued)

FOREIGN PATENT DOCUMENTS

| | | |
|---|---|---|
| JP | 2007-245829 | 9/2007 |
| JP | 2007-111084 | 10/2007 |

(Continued)

*Primary Examiner* — Shaun R Hurley
*Assistant Examiner* — Andrew W Sutton
(74) *Attorney, Agent, or Firm* — Lowe Hauptman & Ham, LLP

(57) ABSTRACT

An airbag device for the body instantaneously activates an airbag without malfunctions.

When an absolute value of an angular velocity detected by an angular velocity sensor exceeds a predetermined angular velocity value, angular velocity values are integrated from a most recent detected value to an oldest value within a predetermined time period, and if an absolute value of a resultant value of integral exceeds a predetermined value and an acceleration detected by an acceleration sensor is smaller than a predetermined acceleration, the airbag is inflated. Based on the value of the integral of the angular velocities, a case in which an angular velocity gradually increases is distinguished from a case in which an angular velocity momentarily increases, so the airbag device effectively prevents malfunctions caused by an action other than falling over. Additionally, because it is unnecessary to intentionally delay determination to prevent malfunctions, the airbag can instantaneously be inflated.

16 Claims, 21 Drawing Sheets

(56) References Cited

U.S. PATENT DOCUMENTS

| | | | | |
|---|---|---|---|---|
| 6,920,647 | B2 * | 7/2005 | Ulert et al. | 2/465 |
| 7,017,195 | B2 * | 3/2006 | Buckman et al. | 2/455 |
| 7,299,507 | B1 * | 11/2007 | Hermoso et al. | 2/467 |
| 7,343,632 | B2 * | 3/2008 | Neron | 2/456 |
| 7,921,472 | B2 * | 4/2011 | Mazzarolo | 2/108 |
| 2003/0023359 | A1 * | 1/2003 | Kueblbeck et al. | 701/45 |
| 2005/0067816 | A1 * | 3/2005 | Buckman | 280/730.1 |
| 2006/0244576 | A1 * | 11/2006 | Sugie et al. | 340/429 |
| 2011/0056291 | A1 * | 3/2011 | Nakamura et al. | 73/504.12 |
| 2012/0131718 | A1 * | 5/2012 | Uchida et al. | 2/69 |
| 2013/0079948 | A1 * | 3/2013 | Hsu et al. | 701/1 |

FOREIGN PATENT DOCUMENTS

| | | |
|---|---|---|
| JP | 2007-260389 | 11/2007 |
| JP | 2008-022943 | 7/2008 |

* cited by examiner

AIRBAG DEVICE FOR THE BODY

RELATED APPLICATIONS

The present application is based on, and claims priority from, JP Application Number 2009-027147, filed Feb. 9, 2009, and PCT Application Number PCT/JP10/051805, filed Feb. 8, 2010, the contents of which are hereby incorporated by reference herein in their entireties.

TECHNICAL FIELD

The present invention relates to an airbag device for the body. Such an airbag device protects a body of an elderly person, a sick person, a handicapped person, and the like from the impact of falling over, or protects a body of a person who works in a high place such as a construction site from the impact of falling to the ground.

BACKGROUND ART

Conventionally, in daily life or while at work, for example, people may tumble over while walking or fall over by a sudden attack of a disease. In such a case, often they are injured by the impact of the falling. In particular, because elderly people have a reduced level of physical ability, they may easily fall over by a slight step or a mild collision, and if they fall over, the lower back, the thigh, the head, and the like may be injured. Also, for example, epileptics may have an epileptic fit and become unconscious to fall over, so that there is a risk that they are hit hard on their heads by their falling.

As a device to protect the body from such falls, an airbag device for the body is known and the airbag device is adapted to absorb the impact of falls by inflating an airbag when an acceleration detected by an acceleration sensor becomes smaller than a predetermined acceleration and an angular velocity detected by an angular velocity sensor becomes greater than a predetermined angular velocity (For example, see Patent Literature 1.).

In the airbag device, when the body becomes in the same state as free fall by falling over or the like, an acceleration detected by the acceleration sensor becomes smaller than a predetermined acceleration, but if it is determined that the body fell over based on only this, an acceleration may be lower than a predetermined acceleration by actions other than falling over such as jumping or leaping slight steps. Therefore, in addition to this condition, only when an angular velocity is generated in any direction by falling over and an angular velocity detected by the angular velocity sensor becomes greater than a predetermined angular velocity, the airbag is inflated. In this case, because an angular velocity may momentarily become greater than the predetermined angular velocity by an abrupt change in posture, only when the determination condition of falling over continues for a predetermined time period or longer, it is determined that the body fell over. As a result, malfunctions are reduced.

CITATION LIST

Patent Literature

Patent Literature 1: Japanese Patent Publication 2008-22943

SUMMARY OF THE INVENTION

Technical Problem

However, to prevent malfunctions, if a determination is intentionally delayed, an actuation time to inflate the airbag is fixed to a predetermined set time. Therefore, if a long actuation time is set, the airbag cannot instantaneously be activated and the inflation may be late for falling over. On the other hand, if a short actuation time is set, a sufficient time to distinguish falling over from another momentary action cannot be held, which easily causes malfunctions. Therefore, there remains a problem that in order to address various types of fall, it is difficult to set a time to activate an airbag.

The present invention has been made to solve the problem, and an object of the invention is to provide an airbag device for the body that can instantaneously activate an airbag without malfunctioning.

Solution to Problem

To achieve the object described above, an airbag device for the body according to the present invention includes: an airbag mounted to cover a predetermined part of the body; an inflating device for inflating the airbag; an acceleration sensor for detecting an acceleration; an angular velocity sensor for detecting an angular velocity; an angular velocity storing device for storing angular velocity values detected by the angular velocity sensor; and a controlling device for, when an absolute value of an angular velocity detected by the angular velocity sensor becomes greater than a predetermined value, integrating angular velocity values stored in the angular velocity storing device from a most recent detected value to an oldest value within a predetermined range, and for, if an absolute value of a resultant value of integral is greater than a predetermined value and an absolute value of an acceleration detected by the acceleration sensor is smaller than a predetermined value, inflating the airbag.

According to the airbag device, angular velocity values stored in the memory are integrated from a most recent detected value to an oldest value within a predetermined range, and if the resultant value of integral is greater than the predetermined value, the airbag is inflated. Therefore, on the basis of the value of integral of angular velocities, a case in which an angular velocity gradually increases such as actual falling over can accurately be distinguished from a case in which an angular velocity momentarily increases such as another abrupt change in posture, as well as it is not necessary to intentionally delay determination so as to prevent malfunctions.

Also, to achieve the object described above, an airbag device for the body according to the present invention include: an airbag mounted to cover a predetermined part of the body; an inflating device for inflating the airbag; an acceleration sensor for detecting an acceleration; an angular velocity sensor for detecting an angular velocity; an angular velocity storing device for storing angular velocity values detected by the angular velocity sensor; and a controlling device for, when an absolute value of an acceleration detected by the acceleration sensor continues to be smaller than a predetermined value for a predetermined time period or longer, inflating the airbag or for, when an absolute value of an angular velocity detected by the angular velocity sensor becomes greater than a predetermined value, integrating angular velocity values stored in the angular velocity storing device from a most recent detected value to an oldest value within a predetermined range, and for, if an absolute value of a resultant value of integral is greater than a predetermined value, inflating the airbag.

According to the airbag device, in addition to the above-described effect, even in a case where there is not a tilt of the body caused by falling over and a value of integral of angular velocities are not greater than a predetermined value, for example in a case where the body falls from a high place in an upright posture, if a state in which an absolute value of an acceleration is smaller than a predetermined value (a free fall state) continues for a predetermined time period or longer, the airbag inflates.

Advantageous Effects of Invention

According to a airbag device for the body of the present invention, a case in which an angular velocity gradually increases such as actual falling over can accurately be distinguished from a case in which an angular velocity momentarily increases such as another abrupt change in posture, so that the airbag device is extremely effective to prevent malfunctions caused by an action other than falling over. In addition, since it is not necessary to intentionally delay determination in order to prevent malfunctions, the airbag can instantaneously be inflated.

Also, according to another airbag device for the body of the present invention, in addition to the above-described effect, the airbag can be inflated even if the body falls without a tilt of the body caused by falling over, for example, in a case in which the body falls from a high place in an upright posture. Therefore, the airbag device is extremely advantageous to protect the body from the impact caused by not only falling over but also a fall from a high place.

DESCRIPTION OF EMBODIMENTS

Figure 1:
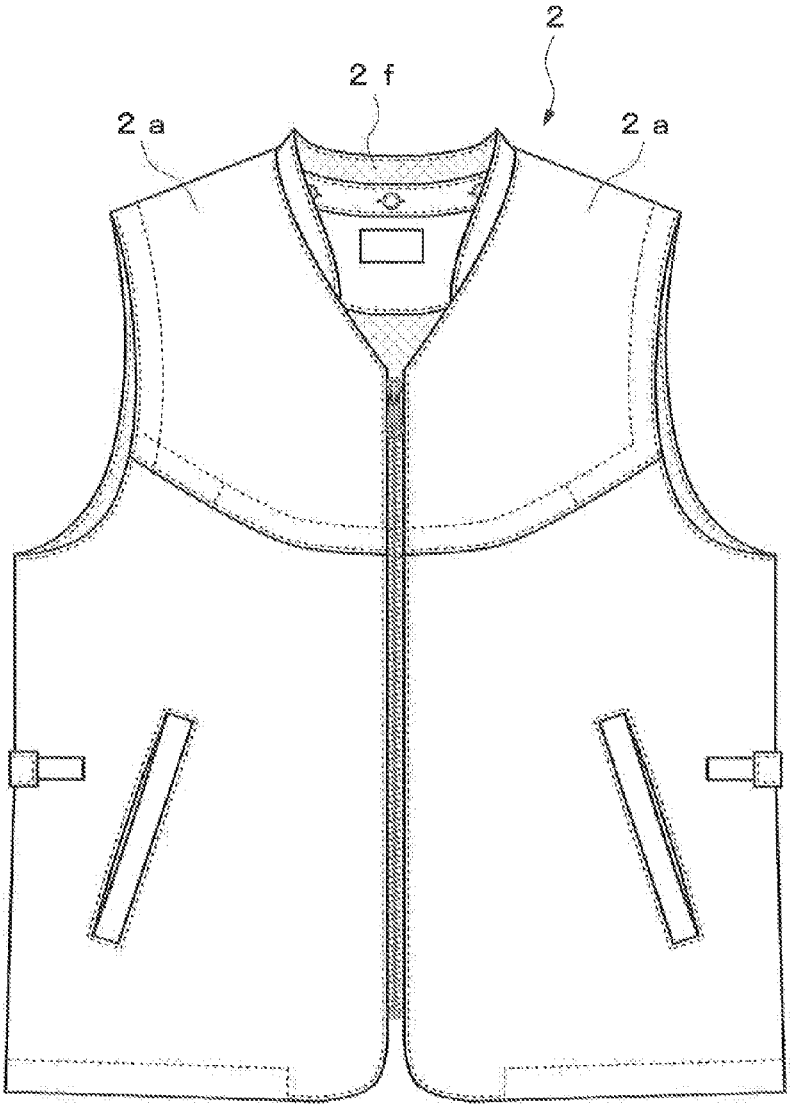
FIG. 1 is a front view of an airbag device for the body according to a first embodiment of the present invention.
Figure 2:
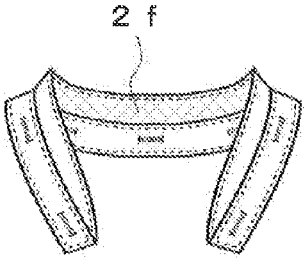
FIG. 2 is a front view of a collar.
Figure 3:
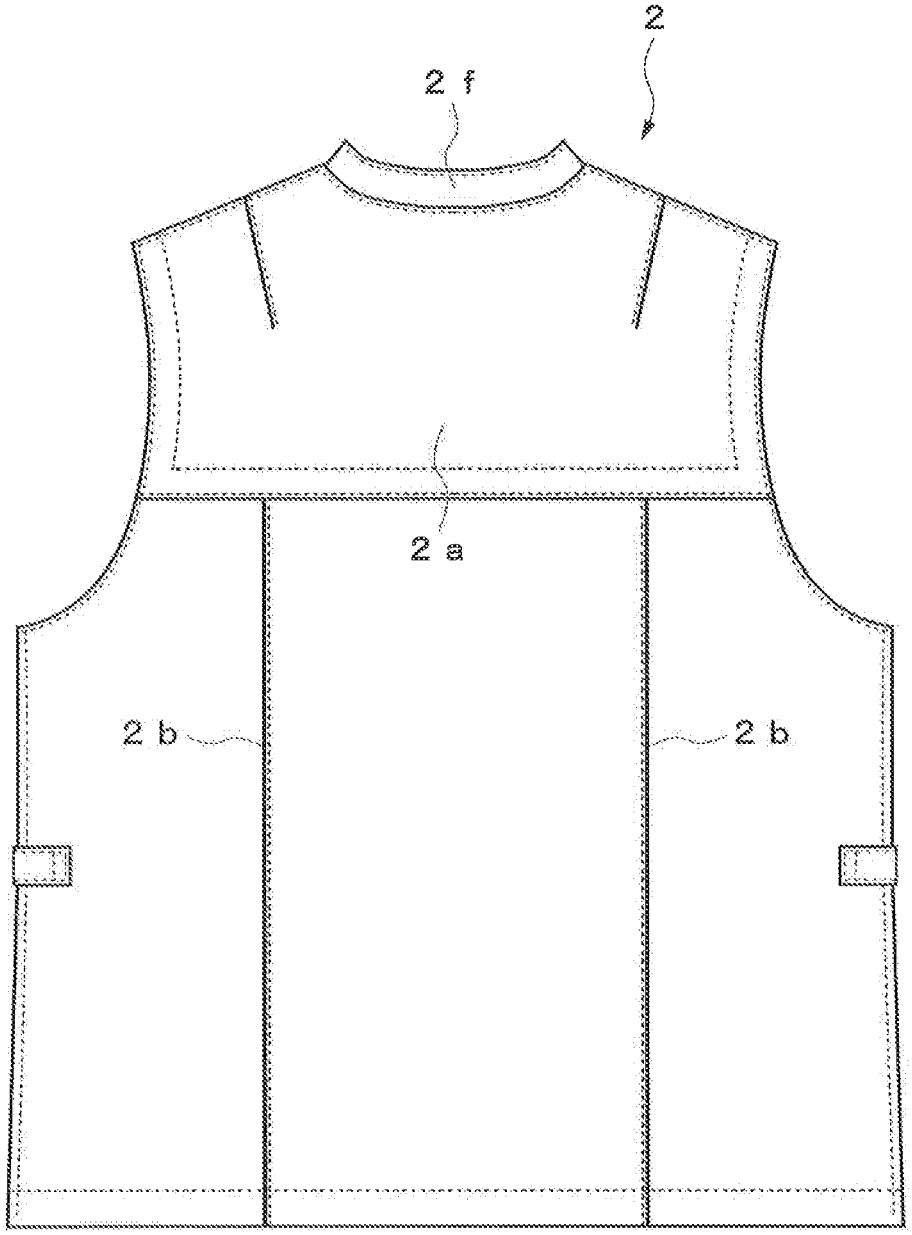
FIG. 3 is a rear view of the airbag device for the body.

FIGS. 1 to 17 illustrate a first embodiment of the present invention.

An airbag device for the body according to this embodiment includes an airbag 1 that can inflate over the head, the back, and the buttocks of the body, a garment 2 that incorporates the airbag 1, a pair of inflators 3 as inflating devices for inflating the airbag 1, an acceleration sensor 4 for detecting an acceleration, an angular velocity sensor 5 for detecting an angular velocity, a memory 6 as an angular velocity storing device for storing angular velocity values detected by the angular velocity sensor 5, and a controller 7 for activating the inflators 3 based on a detected signal of each of the sensors 4 and 5 and the angular velocity values stored in the memory 6.

The airbag 1 is formed of a material having high airtightness and durability (e.g., wholly aromatic polyester), and made into a bag form by sewing or heat-sealing such a material. The airbag 1 is composed of a first airbag portion 1*a* for covering the head of a body A from the back to both the sides, a second airbag portion 1*b* for covering the buttocks of the body A from the back to both the sides, and a third airbag portion 1*c* for covering the back of the body A from the head to the buttocks, and each of the airbag portions 1*a*, 1*b*, and 1*c* are formed integrally with each other. In this case, the first and the second airbag portions 1*a* and 1*b* are communicated with each other via the third airbag portion 1*c*.

Figure 4:
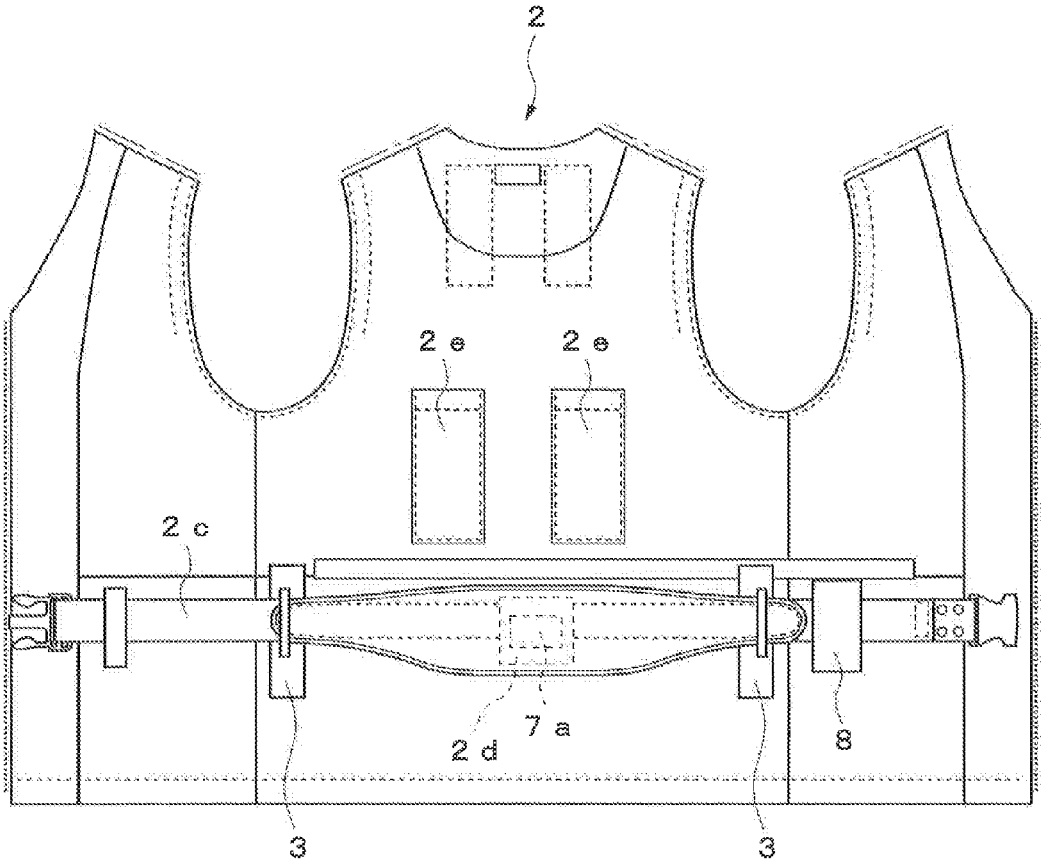
FIG. 4 is a front cut open view of the airbag device for the body.
Figure 5:
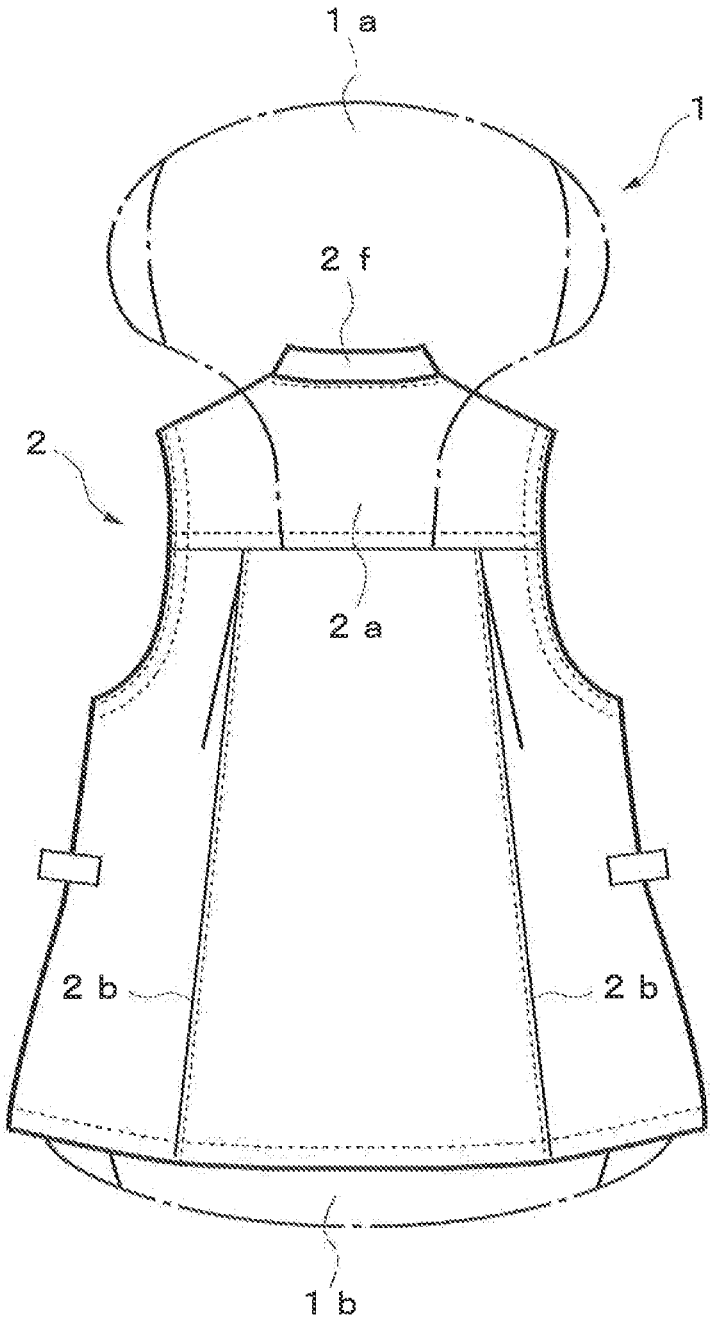
FIG. 5 is a rear view of the airbag device for the body in which the airbag is inflated.
Figure 6:
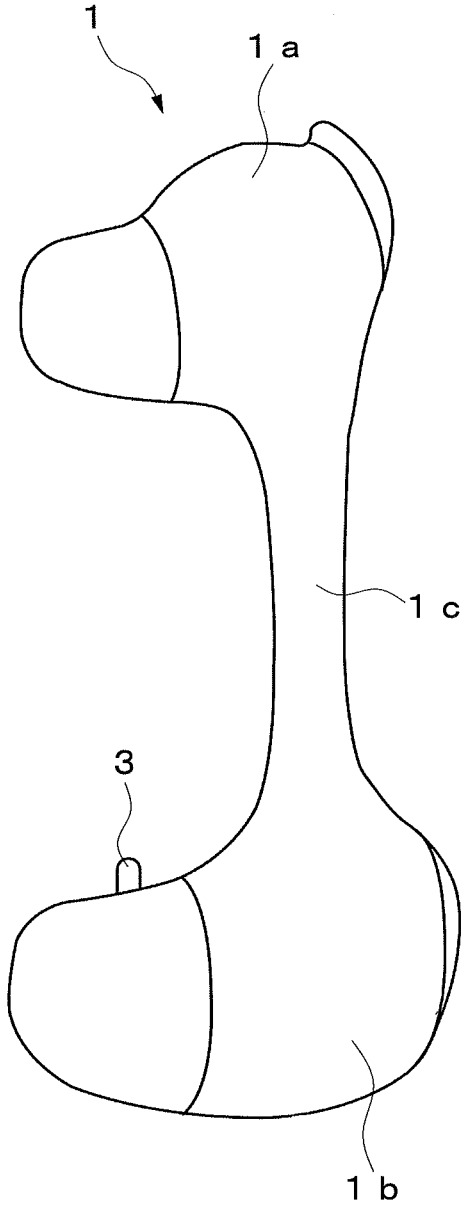
FIG. 6 is a rear perspective view of the airbag.
Figure 7:
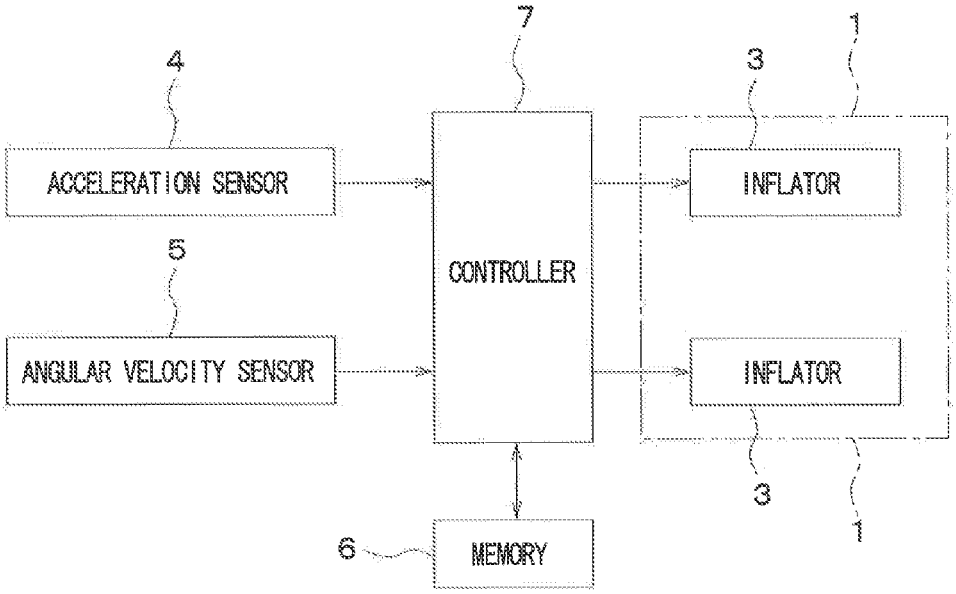
FIG. 7 is a block diagram illustrating a controlling system.
Figure 8:
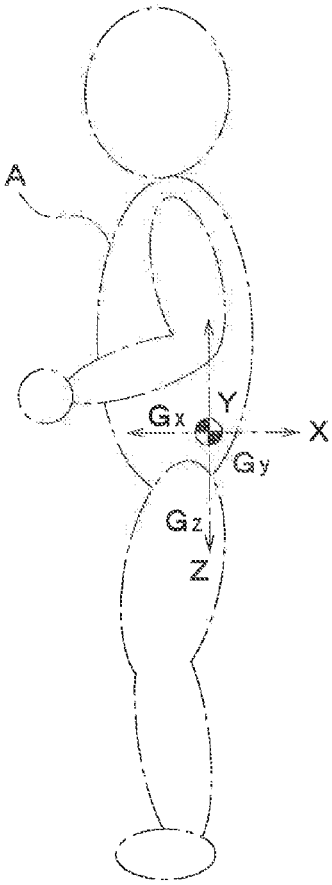
FIG. 8 is a schematic diagram illustrating directions of accelerations.
Figure 9:
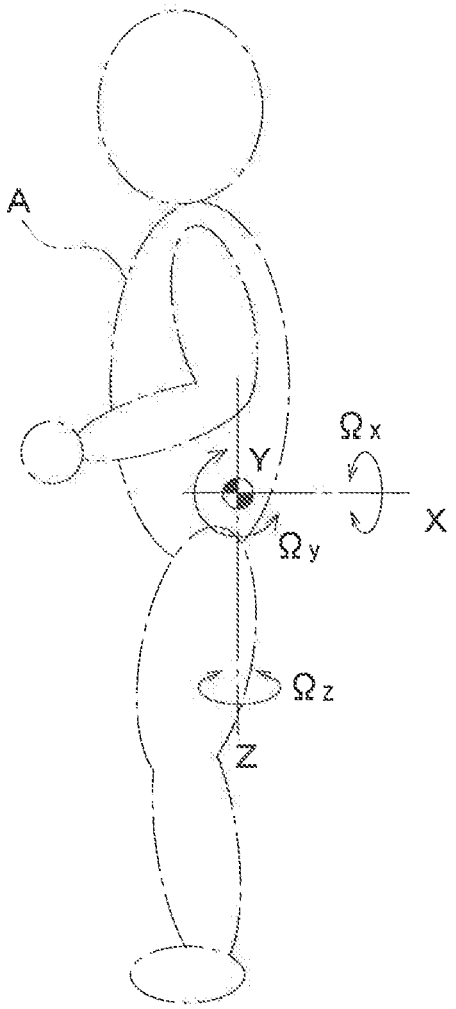
FIG. 9 is a schematic diagram illustrating directions of angular velocities.

The garment 2 is formed into vest-type clothing wearable by the upper part of the body A, and the back of the garment 2 stores the airbag 1 in a deflated state. An upper part of the garment 2 includes a flap 2*a* covering the first airbag portion 1*a*, and the flap 2*a* bulges by the inflation of the first airbag portion 1*a*. Also, the back of the garment 2 includes in the width direction two tucks 2*b* extending vertically, and when the second and the third airbag portions 1*b* and 1*c* are inflated, the back of the garment 2 spreads in the width direction by means of each tuck 2*b*. The inside of the garment 2 includes a torso belt 2*c*, and the center of the torso belt 2*c* includes a sensor receiving unit 2*d* for storing the sensors 4 and 5, or the like. Also, the inside of the garment 2 includes a pair of right and left cooling material receiving units 2*e*, and the cooling material receiving units 2*e* are positioned on the back of the garment 2. Furthermore, the garment 2 has a detachable collar 2*f*, and the collar 2*f* is attached to the garment 2 by a button. It should be noted that FIG. 4 illustrates the garment 2 with the dot-and-dash lines of the shoulders cut off to show the inside of the garment 2.

Each inflator 3 has a well-known configuration to open a cylinder containing compressed fluid by powder explosion, for example, and each inflator 3 is connected with each side of the second airbag portion 1*b* in the width direction. Each inflator 3 ignites the powder by the current of a battery 8, and the battery 8 is mounted on the torso belt 2*c*.

The acceleration sensor 4 is composed of a well-known triaxial acceleration sensor, for example. The acceleration sensor 4 detects each of accelerations around the anterior-posterior direction (X axis), the right-left direction (Y axis), and the height direction (Z axis) of the body A.

The angular velocity sensor 5 is composed of a well-known triaxial angular velocity sensor, for example. The angular velocity sensor 5 detects each of angular velocities around the axes of the anterior-posterior direction (X axis), the right-left direction (Y axis), and the height direction (Z axis) of the body A.

Figure 11:
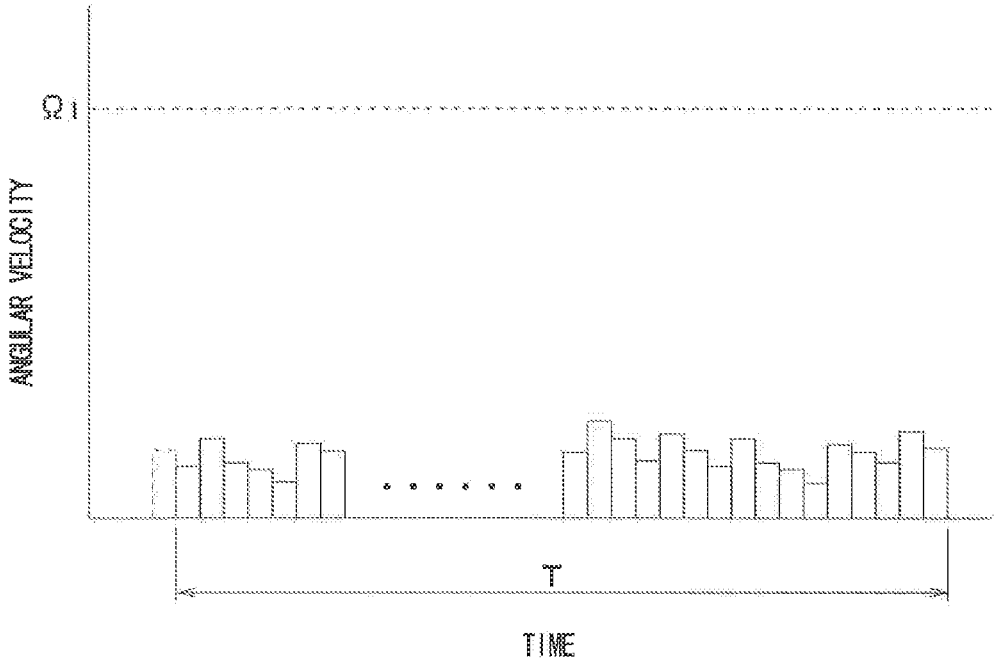
FIG. 11 is a diagram illustrating a range in which angular velocities are stored.

The memory 6 is connected with the angular velocity sensor 5 via the controller 7, and stores only angular velocity values from a most recently detected angular velocity value to an oldest value within a predetermined time period T. That is, as illustrated in FIG. 11, the memory 6 stores angular velocity values detected within the predetermined time period T (e.g., one second), and when a most recent angular velocity value is stored, an oldest angular velocity value (the detected value shown by dotted lines in FIG. 11) is deleted.

The controller 7 is composed of a microcomputer, and is connected with the inflators 3, the acceleration sensor 4, the angular velocity sensor 5, the memory 6, and the battery 8. A circuit board and electrical components composing the controller 7 and the sensors 4 and 5 are included in a controlling unit 7*a*, and the controlling unit 7*a* is included in the sensor receiving unit 2*d* in the garment 2. Also, the controlling unit 7*a* is connected with each inflator 3 via a lead wire (not shown) for a power supply.

Figure 14:
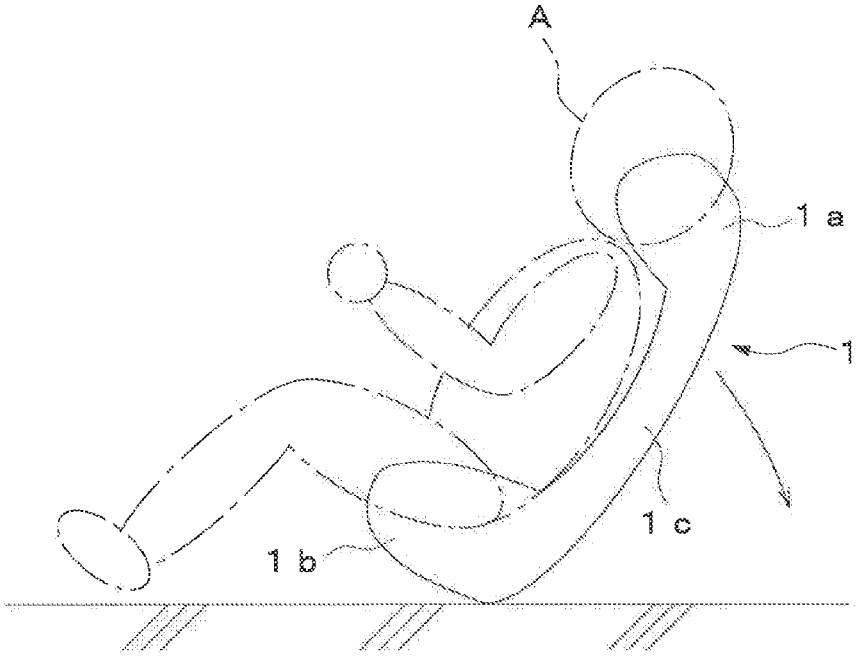
FIG. 14 is a schematic diagram illustrating a movement of falling over.
Figure 15:
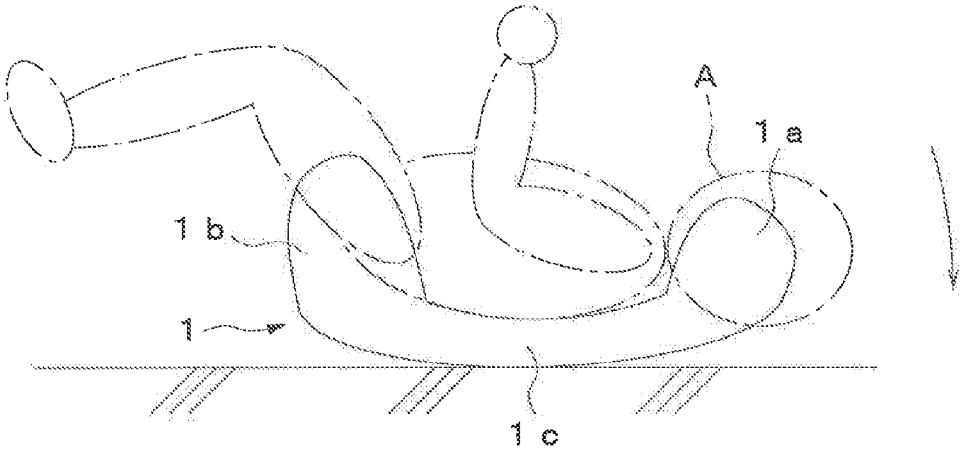
FIG. 15 is a schematic diagram illustrating a movement of falling over.
Figure 16:
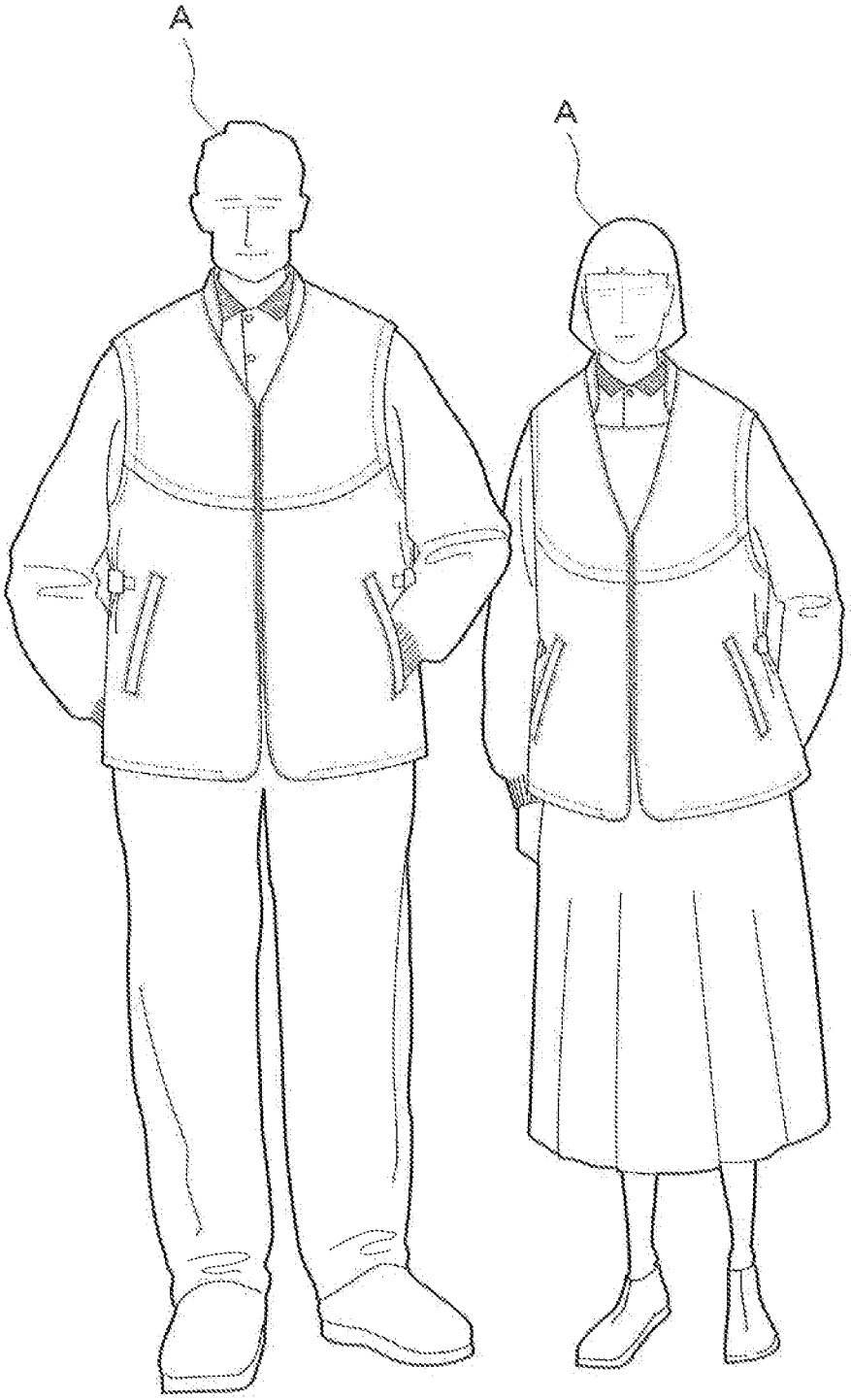
FIG. 16 is a front view showing a wearing example of the airbag device for the body.

As illustrated in FIG. 16, the airbag device for the body configured in this manner is used with the garment 2 worn by the body A of a user. When the user falls over, the inflators 3 is activated to instantaneously inflate the airbag 1. Thus, the head, the buttocks, and the back of the body A are covered by the airbag 1. If the user falls over backward, as illustrated in FIG. 14, the impact on the buttocks of the body A is absorbed by the second airbag portion 1*b*, and as illustrated in FIG. 15, the impacts on the head and the back of the body A are absorbed by the first and the third airbag portions 1*a* and 1*c*, respectively.

Figure 10:
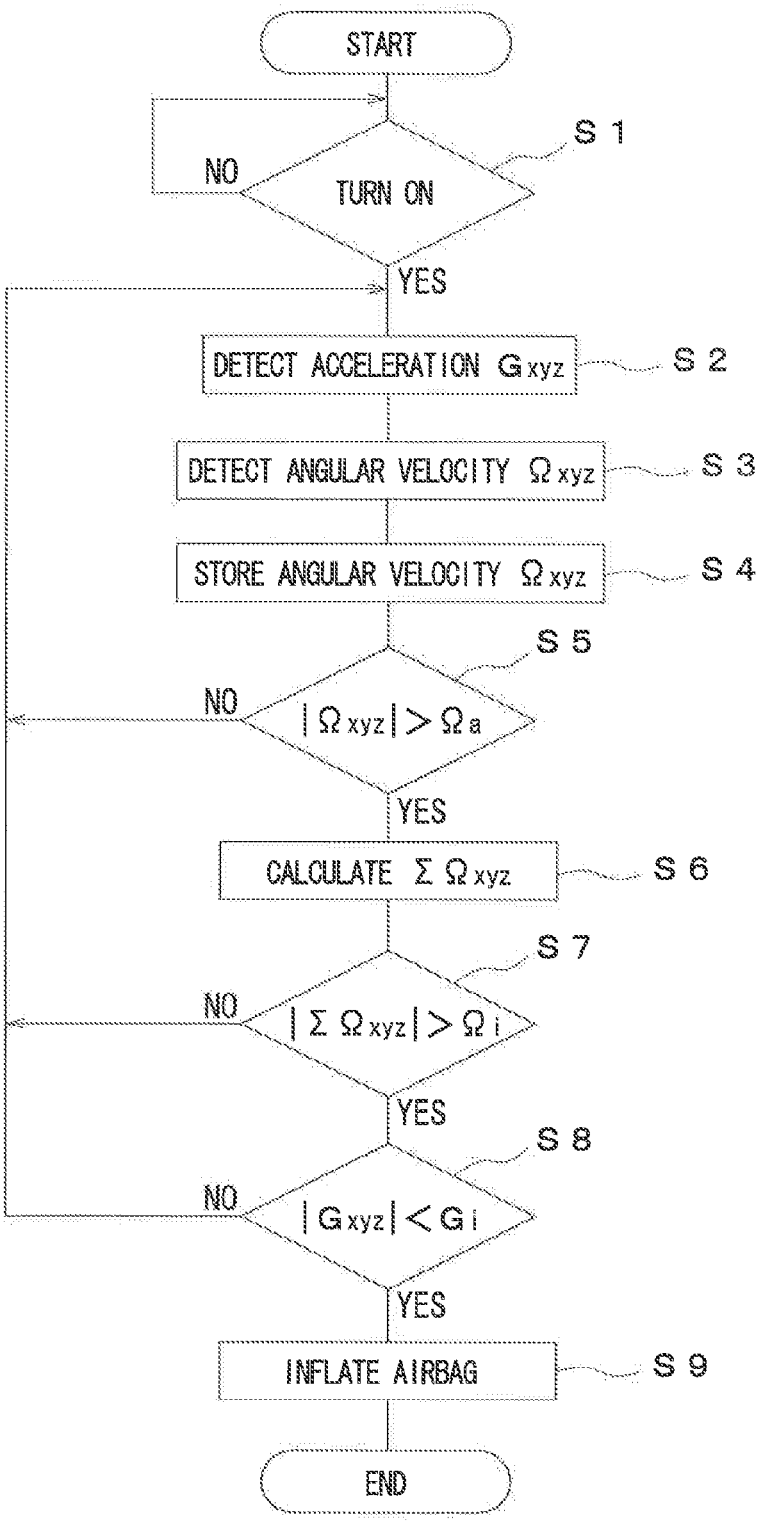
FIG. 10 is a flow chart showing an operation of a controller.

Next, referring to a flow chart of FIG. 10, an operation of the controller 7 will be described. First, when a main switch, not shown, is turned on (S1), the acceleration sensor 4 detects accelerations Gx, Gy, and Gz (S2), the angular velocity sensor 5 detects angular velocities Ωx, Ωy, and Ωz (S3), and the angular velocities Ωx, Ωy, and Ωz are stored in the memory 6 (S4). When a most recent angular velocity value is stored in the memory 6, an oldest angular velocity value is deleted from the memory 6. Then, an absolute value |Ωxyz| of any one of the angular velocities Ωx, Ωy, and Ωz is greater than a predetermined reference value Ωa (S5), values of integral ΣΩx, ΣΩy, and ΣΩz are calculated by integrating the angular velocity values stored in the memory 9 from a most recent angular velocity value to an oldest value within a predetermined time period T (S6), and if an absolute value |ΣΩxyz| of any one of these values is greater than a predetermined reference value Ωi (S7) and an absolute value |Gxyz| of each of the accelerations Gx, Gy, and Gz is smaller than a predetermined reference value Gi (S8), each inflator 3 is activated to inflate the airbag 1 (S9).

The reference value Gi of the acceleration is set at a value equal to or smaller than gravitational acceleration, and when the body A enters a state similar to free fall by falling over or the like, the absolute value |Gxyz| of the detected values becomes smaller than the reference value Gi. If it is determined that the body A fell over based on only this, when the body jumps or leaps small steps, an acceleration may be smaller than the reference value Gi by an action other than falling over. Therefore, because when the body falls over, an angular velocity is generated in any direction, only if an absolute value of an acceleration is smaller than the reference value Gi and an absolute value of an angular velocity is greater than the reference value Ωa, it is determined that the body fell over. As a result, malfunctions are reduced.

Figure 12:
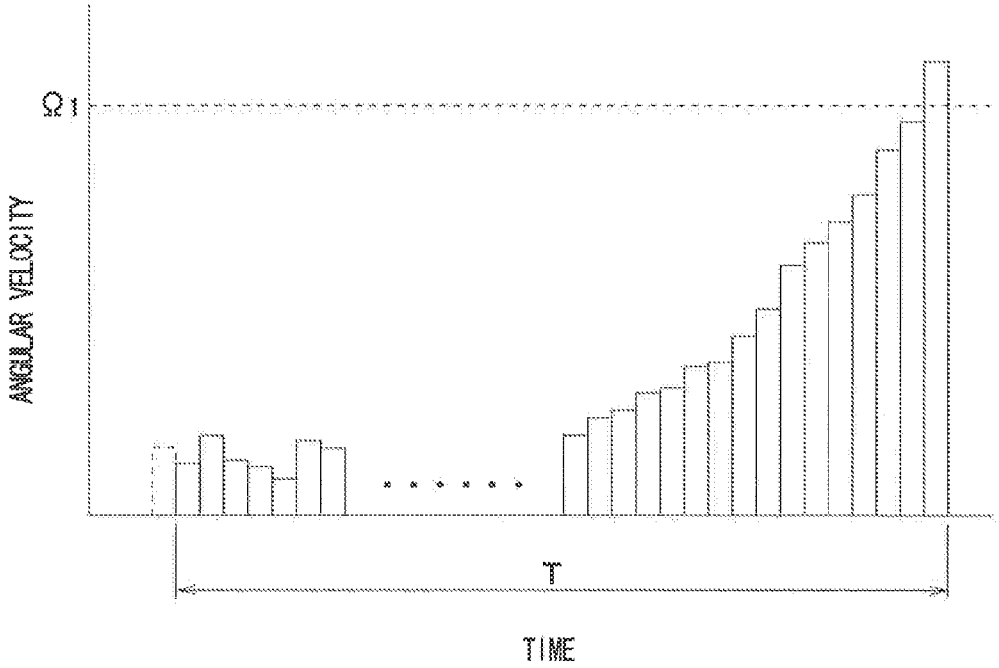
FIG. 12 is a diagram illustrating an example of variance of angular velocities.
Figure 13:
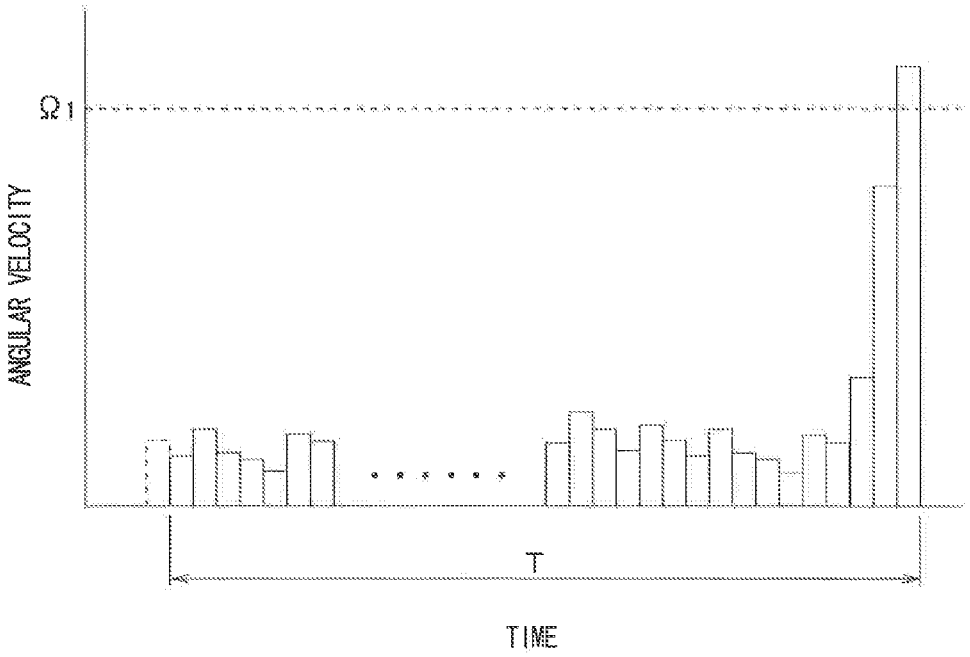
FIG. 13 is a diagram illustrating another example of variance of angular velocities.

Additionally, even in such a case, because the condition mentioned above may momentarily be met by an abrupt change in posture, angular velocity values are integrated from a most recent angular velocity value to an oldest value within a predetermined time period T to calculate a value of integral corresponding to a tilt angle, and only if the absolute value ⊕ΣΩxyz| is greater than the predetermined reference value Ωi, it is determined that the body fell over. As a result, malfunctions are reduced. That is, if the body actually falls over, as illustrated in FIG. 12, an angular velocity value gradually increases before the angular velocity becomes greater than a reference value Ω1, but in an abrupt change in posture other than falling over, as illustrated in FIG. 13, because an angular velocity value momentarily increases just before it becomes greater than the reference value Ωa, a value of integral of the angular velocity values is added to the determination condition to enhance accuracy of distinguishing falling over from another action. In this case, since an activation condition is determined based on the value of integral of the angular velocity values from the most recent angular velocity to the oldest value within the predetermined time T in order to prevent malfunctions, it is not necessary to intentionally delay the determination, and if the acceleration and the angular velocity meet the determination condition, the airbag 1 instantaneously inflates.

It should be noted that if an angle is obtained by integrating angular velocities, an offset component of the angular velocity sensor 5 is added, and there arises a problem that a value of integral increases even if there is no angular change, but in this embodiment, an integral range is limited to a predetermined time period T, and each time a most recent angular velocity value is stored, an oldest angular velocity value is deleted, so that the offset component of the angular velocity sensor 5 remains constant, and a value of integral does not increase in a stationary state.

Thus, according to this embodiment, because the acceleration sensor 4 for detecting accelerations in the triaxial directions of the body A and the angular velocity sensor 5 for detecting angular velocities around the three axes of the body A are included, it is ensured that falling over in multiple directions can be sensed, and thereby the airbag 1 can effectively protect an elderly person, a sick person, and the like from unexpected falling over.

In this case, when an absolute value of the angular velocity detected by the angular velocity sensor 5 becomes greater than the predetermined angular velocity, the angular velocity values stored in the memory 6 are integrated from a most recent value to an oldest value within the predetermined time period T, and if an absolute value of the value of integral is greater than the predetermined value and an absolute value of the acceleration detected by the acceleration sensor 4 is smaller than the predetermined acceleration, the airbag 1 is inflated. Therefore, on the basis of a value of integral of the angular velocities, a case in which an angular velocity gradually increases such as actual falling over can accurately be distinguished from a case in which an angular velocity momentarily increases such as an abrupt change in posture other than falling over, so that the airbag device is extremely effective to prevent malfunctions caused by an action other than falling over. In addition, because it is not necessary to intentionally delay the determination in order to prevent malfunctions, the airbag 1 can instantaneously be inflated to appropriately address different falling over states.

Furthermore, since only the angular velocity values from a most recently detected angular velocity value to an oldest value within the predetermined time period T are stored in the memory 6, the capacity of the memory 6 can be reduced to also reduce the size and the cost of the memory 6.

In addition, since the first, the second, and the third airbag portions 1*a*, 1*b*, and 1*c* of the airbag 1 cover the head, the buttocks, and the back of the body A, the airbags are effective in a case where a user falls on his/her buttocks as well as a case where users hit hard on the heads by their falling, such as a case in which an epileptic has an epileptic fit and becomes unconscious to fall over.

Moreover, since the airbag 1 is included in the garment 2, which has a clothing form wearable by the body A, a user can easily wear the garment 2 as if the user put on clothing. In addition, since the garment 2 is formed into vest-type clothing, the garment 2 does not make the user look less attractive. In this case, the cooling material receiving units 2*e* hold cooling materials, and thereby the garment 2 can be worn with comfort even in a hot climate like in summer. Also, when the collar becomes dirty, the collar 2*f* can be detached from the garment 2 and be washed, so that the whole garment 2 is not needed to be washed. Therefore, the airbag device is extremely advantageous in practical use.

It should be noted that in the above-described embodiment, although the triaxial acceleration sensor is used as the acceleration sensor 4 and the triaxial angular velocity sensor is used as the angular velocity sensor 5, a biaxial sensor or multiple uniaxial sensors can be used. Alternatively, multiple triaxial sensors may be adopted to configure a sensor using more axes.

Also, in the above-described embodiment, the airbag 1 in which the airbag portions 1*a*, 1*b*, and 1*c* covering the head, the buttocks, and the back of the body A are formed integrally with each other is described, but these airbag portions may be formed separately or the airbag may include one or two of the airbag portions. In addition, if an airbag portion to cover the front of the head is further mounted, when a user falls over forward, the impact on the face can be absorbed.

Also, in the above-described embodiment, the described example assumes that an elderly person or a sick person falls over, but a person who works in high places such as construction sites may wear the garment to absorb a drop impact if the person falls from a high place.

Figure 17:
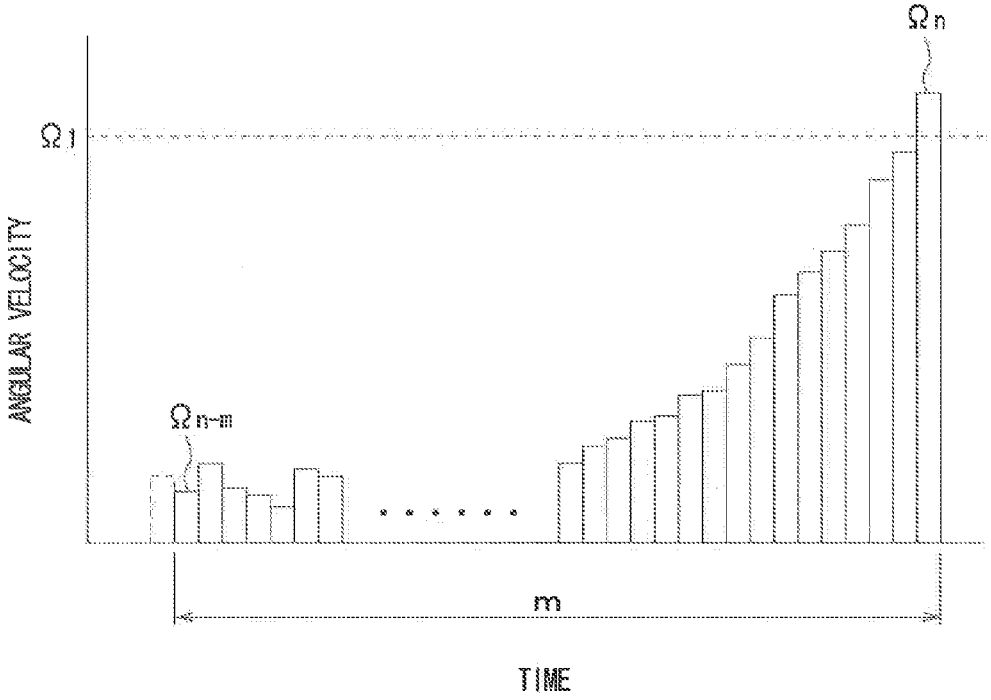
FIG. 17 is a diagram illustrating an example of variance of angular velocities in another controlling example of the present invention.
Figure 18:
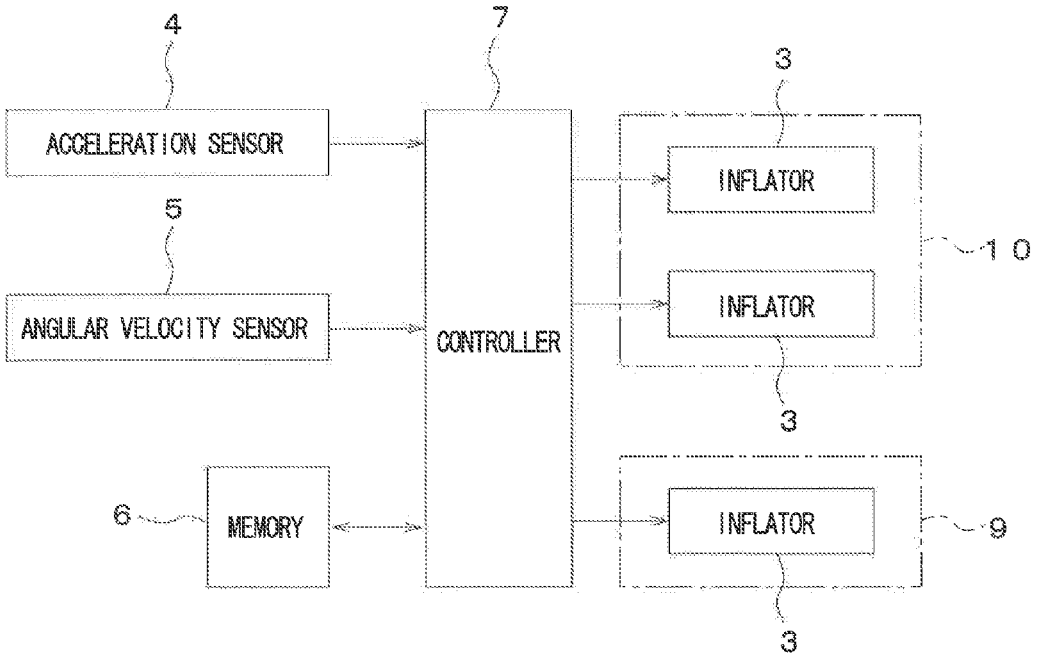
FIG. 18 is a block diagram of a controlling system illustrating a second embodiment of the present invention.
Figure 19:
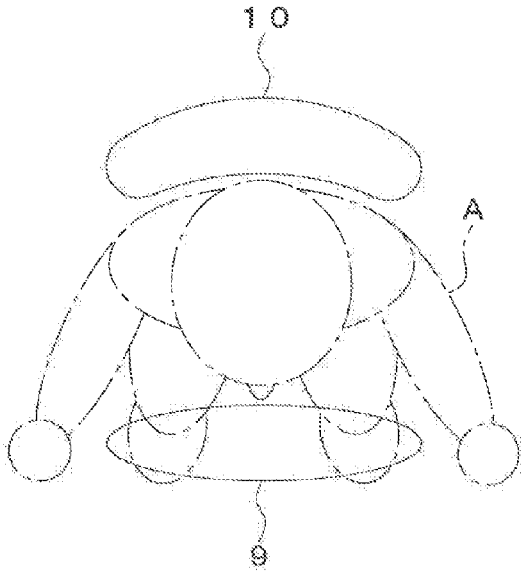
FIG. 19 is a schematic plan view of an airbag.

Furthermore, in the above-described embodiment, angular velocity values within a predetermined range from a most recent value to an oldest value within a predetermined time period T are integrated, but as illustrated in FIG. 17, angular velocity values within a predetermined range between a most recent detected value and an m-th value, m being the predetermined number of detection times (e.g., 1000 times), may be integrated. That is, if it is assumed that an n-th (n= 1, 2, 3, . . . ) detected angular velocity value is Ωn, values between an (n−m)th angular velocity value Ωn−m and a most recent angular velocity value Ωn are integrated. In this case, the memory 6 may be adapted to store m angular velocity values, m being the predetermined detection number of times, and to, if a most recent angular velocity value is stored, delete an oldest angular velocity value.

FIGS. 18 to 22 illustrate a second embodiment of the present invention and the same components as those described in the first embodiment are denoted by the same reference numerals.

In this embodiment, the airbag device includes a front airbag 9 on the front of the body A and a rear airbag 10 on the rear of the body A, and the other components are same as those of the first embodiment.

The front airbag 9 and the rear airbag 10 are included in the same garment 2 as that of the first embodiment, and the front airbag 9 is formed so as to mainly cover the face and the breast of the body A. The rear airbag 10 has the same configuration as the airbag 1 of the first embodiment, and is formed so as to cover the back of the head, the back, and the buttocks of the body A. Also, each of the airbags 9 and 10 is inflated by a specific one of the inflators 3, and each of the inflators 3 is connected with the controller 7.

Figure 20:
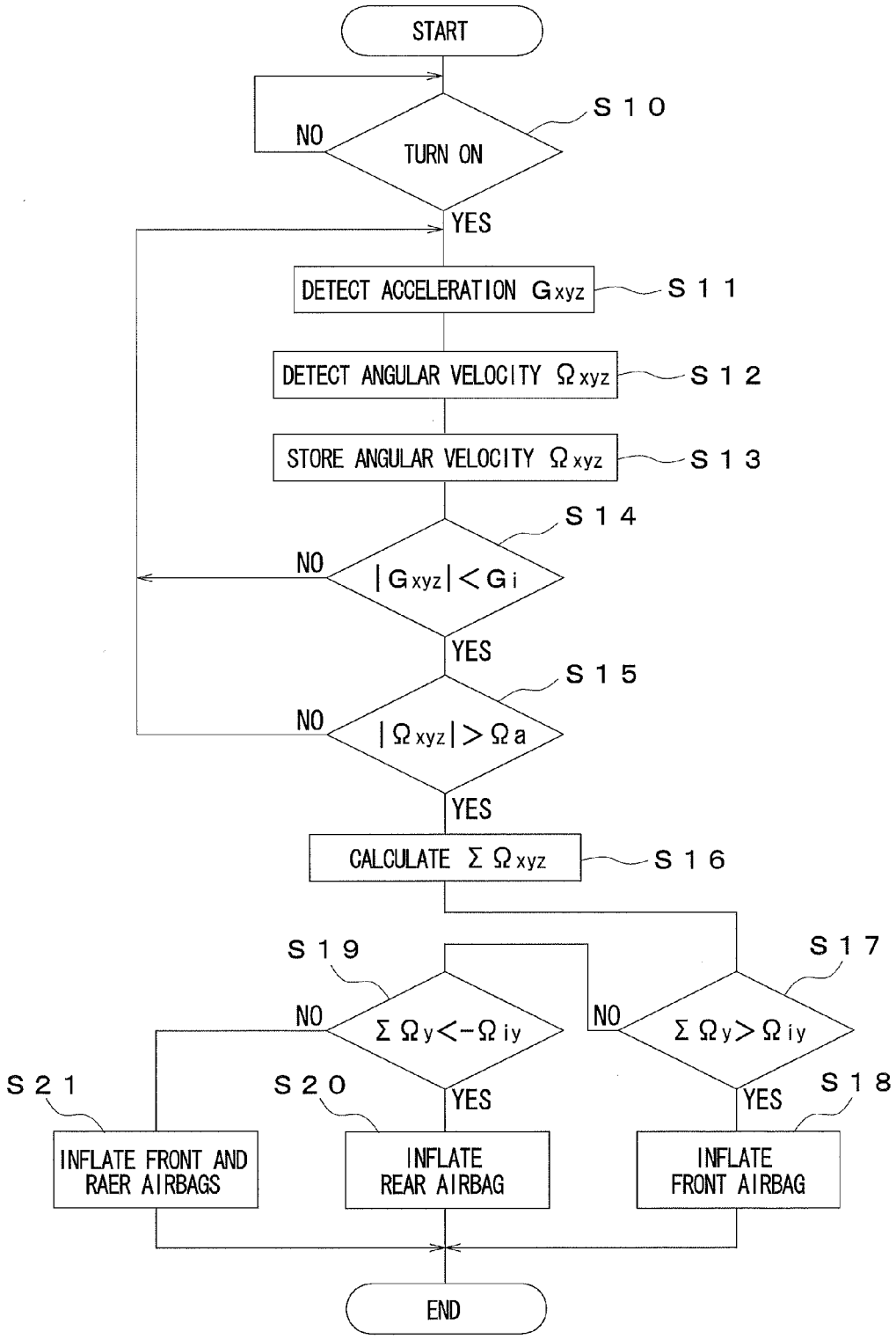
FIG. 20 is a flow chart showing an operation of a controller.

Now, referring to a flow chart shown in FIG. 20, an operation of the controller 7 will be described. It should be noted that as an angular velocity around the Y axis, with respect to FIG. 9, it is assumed that a value obtained by turning counterclockwise (forward tilt of the body) is positive and a value obtained by turning clockwise (backward tilt of the body) is negative.

Figure 21:
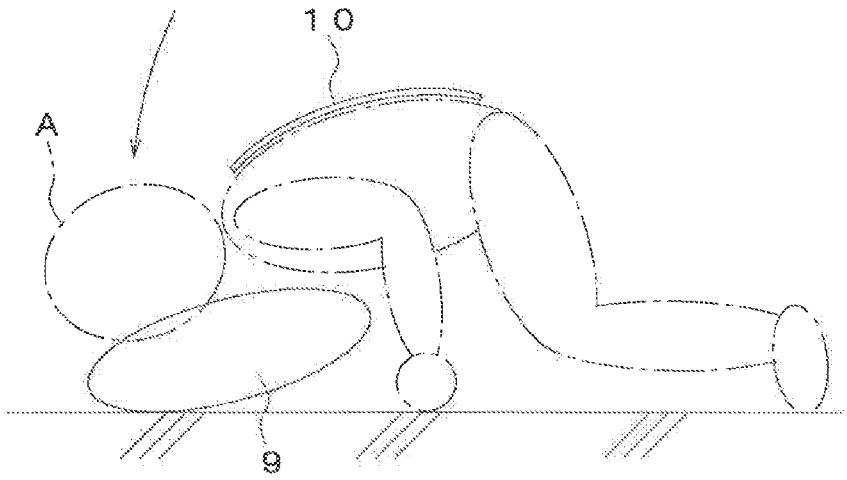
FIG. 21 is a schematic diagram illustrating a movement of falling over forward.
Figure 22:
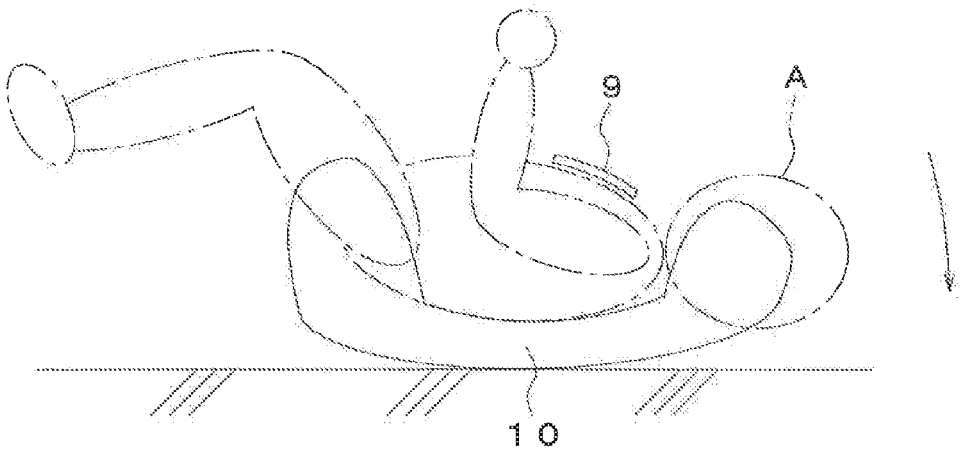
FIG. 22 is a schematic diagram illustrating a movement of falling over backward.

First, a main switch, not shown, is turned on (S10), the acceleration sensor 4 detects accelerations Gx, Gy, and Gz (S11), the angular velocity sensor 5 detects angular velocities Ωx, Ωy, and Ωz (S12), and the angular velocities Ωx, Ωy, and Ωz are stored in the memory 6 (S13). When a most recent angular velocity value is stored in the memory 6, an oldest angular velocity value is deleted from the memory 6. Then, if an absolute value |Gxyz| of each of the accelerations Gx, Gy, and Gz becomes smaller than a predetermined reference value Gi (S14) and an absolute value |Ωxyz| of any one of the angular velocities Ωx, Ωy, and Ωz becomes greater than a predetermined reference value Ωa (S15), values of integral ΣΩx, ΣΩy, and ΣΩz are calculated by integrating angular velocity values stored in the memory 9 from a most recent angular velocity value to an oldest value within a predetermined time period T (S16), if a value of integral ΣΩy of angular velocities around the Y axis is greater than a positive value of a predetermined reference value Ωiy (S17), as illustrated in FIG. 21, it is determined that the body A fell over forward, and the inflator 3 for the front airbag 9 is activated to inflate the front airbag 9 (S18). Also, in step S17, if a value of integral ΣΩy of angular velocities around the Y axis is equal to or smaller than a positive value of the reference value Ωiy and the value of integral ΣΩy is smaller than a negative value of the reference value Ωiy (S19), as illustrated in FIG. 22, it is determined that the body A fell over backward, and the inflator 3 for the rear airbag 10 is activated to inflate the rear airbag 10 (S20). In addition, in step S19, if a value of integral ΣΩy of the angular velocities around the Y axis is equal to or greater than a negative value of the reference value Ωiy, it is determined that a falling direction is unknown, and both the front and the rear airbags 9 and 10 are inflated (S21).

It should be noted that in this embodiment, if a value of integral ΣΩy of angular velocity values in a detection direction of the angular velocity sensor 5 is greater than a positive value of the reference value Ωiy and the value of integral ΣΩy is smaller than a negative value of the reference value Ωiy, the airbag is inflated. However, this condition is equivalent to a case in which an "absolute value" of a value of integral ΣΩy of angular velocity values in a detection direction of the angular velocity sensor 5 becomes greater than the reference value Ωiy. That is, as another controlling example, if an absolute value of a value of integral ΣΩy of angular velocity values is greater than a predetermined reference value Ωiy, it is determined whether the value of integral ΣΩy is positive or negative, and if the value is positive, the front airbag 9 may be inflated and if the value is negative, the rear airbag 10 may be inflated.

Therefore, according to this embodiment, because the front airbag 9 and the rear airbag 10 which correspond to the anterior and the posterior directions of the body, respectively, are included, and the airbag corresponding to the direction in which an absolute value of a value of integral ΣΩy of angular velocity values becomes greater than the predetermined reference value Ωiy is inflated, if the body falls over forward, only the front airbag 9 can be inflated, and if the body falls over backward, only the rear airbag 10 can be inflated. That is, the used airbag device in which the airbag has been inflated can be reused by replacing the inflator 3, but in this embodiment, because only the airbag corresponding to the direction in which the body falls over is inflated, only the inflator 3 for the inflated one of the front and the rear airbags 9 and 10 may be replaced, so that maintenance costs for reuse can be lowered.

Figure 23:
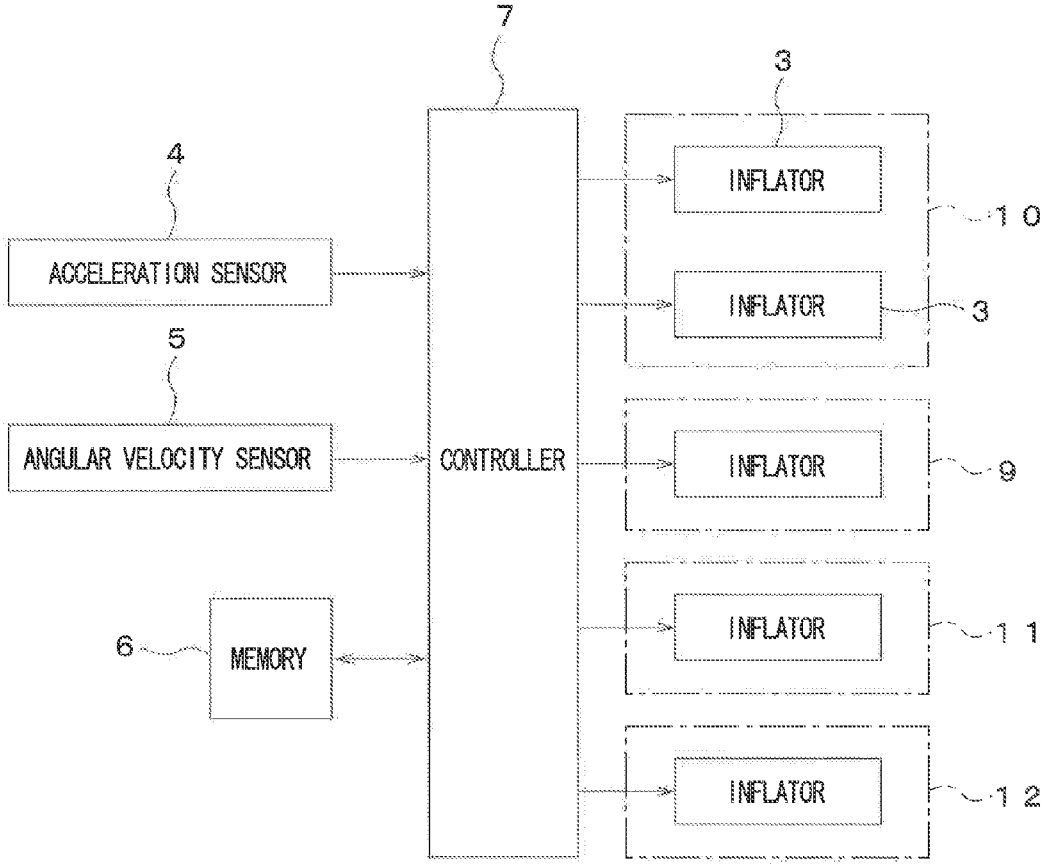
FIG. 23 is a block diagram of a controlling system illustrating a third embodiment of the present invention.
Figure 24:
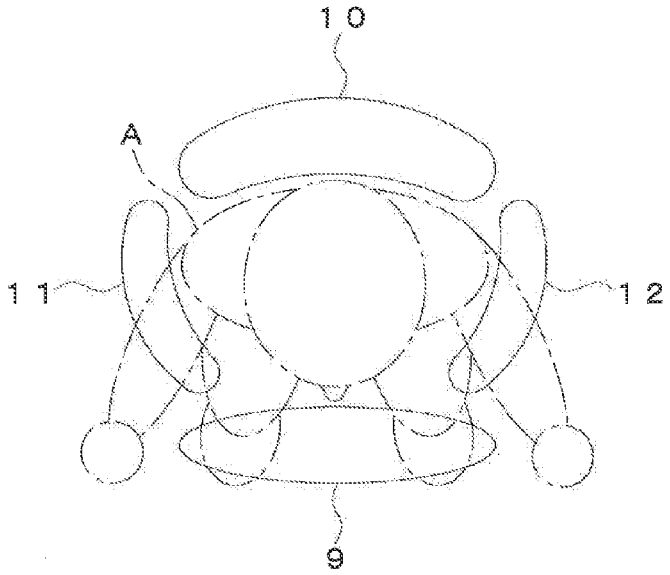
FIG. 24 is a schematic plan view showing an airbag.
Figure 25:
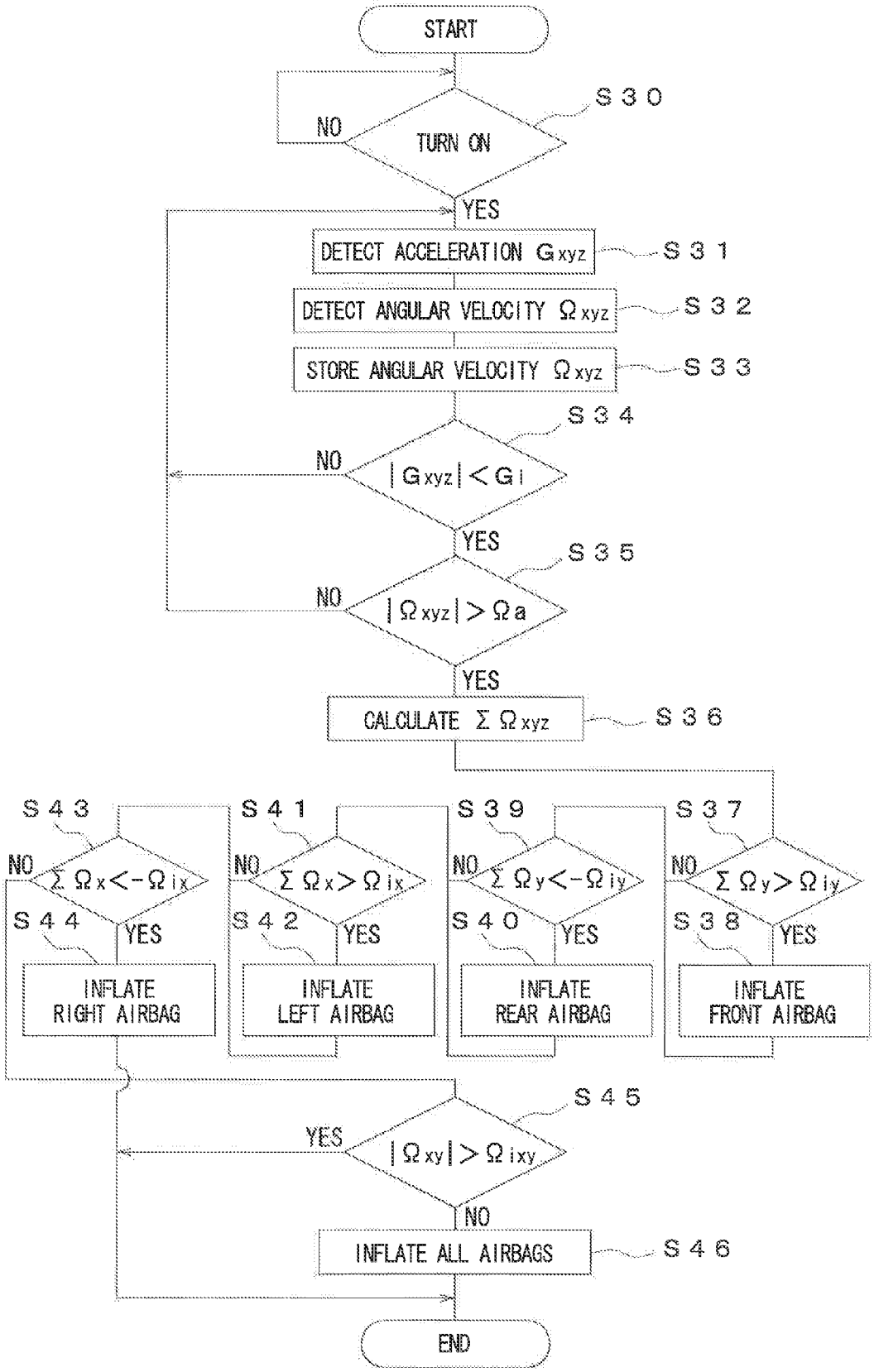
FIG. 25 is a flow chart showing an operation of a controller.

FIGS. 23 to 25 illustrate a third embodiment of the present invention and the same components as those described in the first and the second embodiments are denoted by the same reference numerals.

In the embodiment, the front airbag 9 and the rear airbag 10 as well as the left airbag 11 positioned at the left side of the body A and the right airbag 12 positioned at the right side of the body A are included, and the other components are same as those of the first and the second embodiments.

The left airbag 11 and the right airbag 12 are mounted in the same garment 2 as that of the first embodiment and formed so as to cover the sides of the body A. Also, each of the airbags 9, 10, 11, and 12 is inflated by a specific one of the inflators 3, and each of the inflators 3 is connected with the controller 7.

Now, referring to a flow chart shown in FIG. 24, an operation of the controller 7 will be described. It should be noted that as an angular velocity around the X axis, with reference to FIG. 9, it is assumed that a value obtained by turning counterclockwise viewed from the front of the body (leftward tilt of the body) is positive and a value obtained by turning clockwise (rightward tilt of the body) is negative. As an angular velocity around the Y axis, with reference to FIG. 9, it is assumed that a value obtained by turning counterclockwise (forward tilt of the body) is positive and a value obtained by turning clockwise (backward tilt of the body) is negative.

First, when a main switch, not shown, is turned on (S30), the acceleration sensor 4 detects accelerations Gx, Gy, and Gz (S31), the angular velocity sensor 5 detects angular velocities Ωx, Ωy, and Ωz (S32), and the angular velocities Ωx, Ωy, and Ωz are stored in the memory 6 (S33). When a most recent angular velocity value is stored in the memory 6, an oldest angular velocity value is deleted from the memory 6. Then, if an absolute value |Gxyz| of each of the accelerations Gx, Gy, and Gz becomes smaller than a predetermined reference value Gi (S34) and an absolute value |Ωxyz| of any one of the angular velocities Ωx, Ωy, and Ωz becomes greater than a predetermined reference value Ωa (S35), values of integral ΣΩx, ΣΩy, and ΣΩz are calculated by integrating angular velocity values stored in the memory 9 from a most recent angular velocity value to an oldest value within a predetermined time period T (S36), and if a value of integral ΣΩy of the angular velocities around the Y axis is greater than a positive value of a predetermined reference value Ωiy (S37), it is determined that the body A fell over forward, and the inflator 3 for the front airbag 9 is activated to inflate the front airbag 9 (S38). Then, after the front airbag 9 is inflated in step S38 or in a case where the value of integral ΣΩy of the angular velocities around the Y axis is equal to or smaller than the positive value of the reference value Ωiy in step S37, if the value of integral ΣΩy is smaller than a negative value of the reference value Ωiy (S39), it is determined that the body A fell over backward, and the inflator 3 for the rear airbag 10 is activated to inflate the rear airbag 10 (S40). Then, after the rear airbag 10 is inflated in step S40 or in a case where the value of integral ΣΩy of the angular velocities around the Y axis is equal to or greater than the negative value of the reference value Ωiy in step S39, if a value of integral ΣΩx of angular velocities around the X axis is greater than a positive value of a predetermined reference value Ωix (S41), it is determined that the body A fell over leftward, and the inflator 3 for the left airbag 11 is activated to inflate the left airbag 11 (S42). Then, after the left airbag 9 is inflated in step S42 or in a case where the value of integral ΣΩx of the angular velocities around the X axis is equal to or smaller than the positive value of the reference value Ωix in step S41, if the value of integral ΣΩx is smaller than a negative value of the reference value Ωix (S43), it is determined that the body A fell over rightward, and the inflator 3 for the right airbag 12 is activated to inflate the right airbag 12 (S44). Also, if the value of integral ΣΩx of the angular velocities around the X axis is equal to or greater than the negative value of the reference value Ωix in step S43 and an absolute value |Ωxy| of each of the angular velocities Ωx and Ωy is equal to or smaller than the reference values Ωix and Ωiy (S45), it is determined that a direction in which the body fell over is unknown, and all the airbags 9, 10, 11, and 12 are inflated (S46).

Thus, according to this embodiment, since the front, the rear, the left, and the right airbags 9, 10, 11, and 12, each of which corresponds to the anterior, the posterior, the left, and the right directions from the body, respectively are included, if the body falls over in the anterior-posterior direction as described in the second embodiment as well as if the body falls over in the right-left direction, only the airbag corresponding to the falling direction of the anterior, the posterior, the left, and the right directions can be inflated.

In this case, since the airbag corresponding to a direction in which an absolute value of a value of integral ΣΩixy of the angular velocity values is greater than a predetermined reference value Ωixy is inflated, if the body falls over diagonally forward left for example and each of a value of integral ΣΩiy of forward angular velocity values and a value of integral ΣΩix of leftward angular velocity values becomes greater than the reference value Ωixy, each of the front airbag 9 and the left airbag 11 is inflated, so that the user can adequately be protected from the impact caused by falling over in a diagonal direction.

Figure 26:
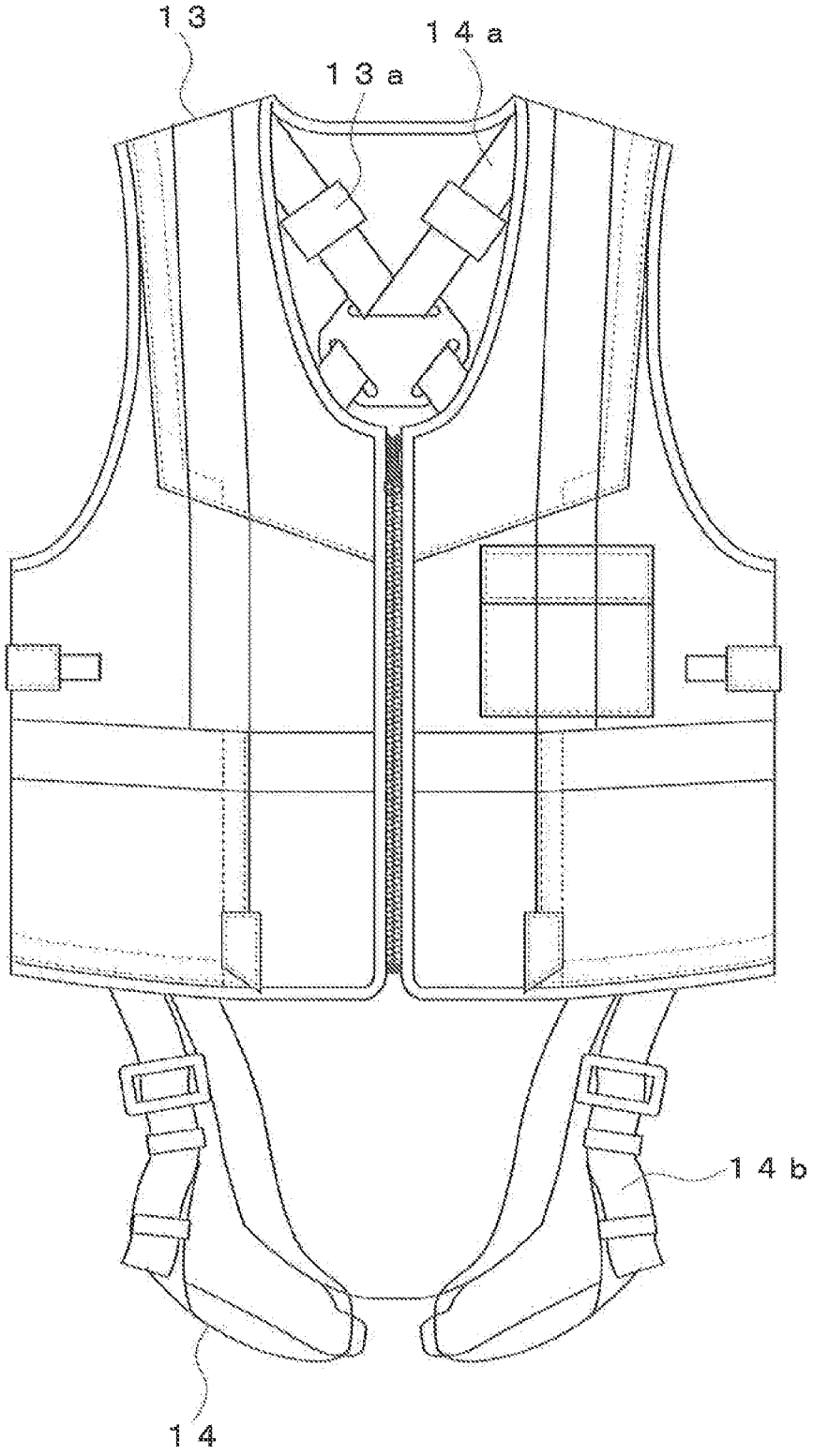
FIG. 26 is a front view of an airbag device for the body illustrating a fourth embodiment of the present invention.
Figure 27:
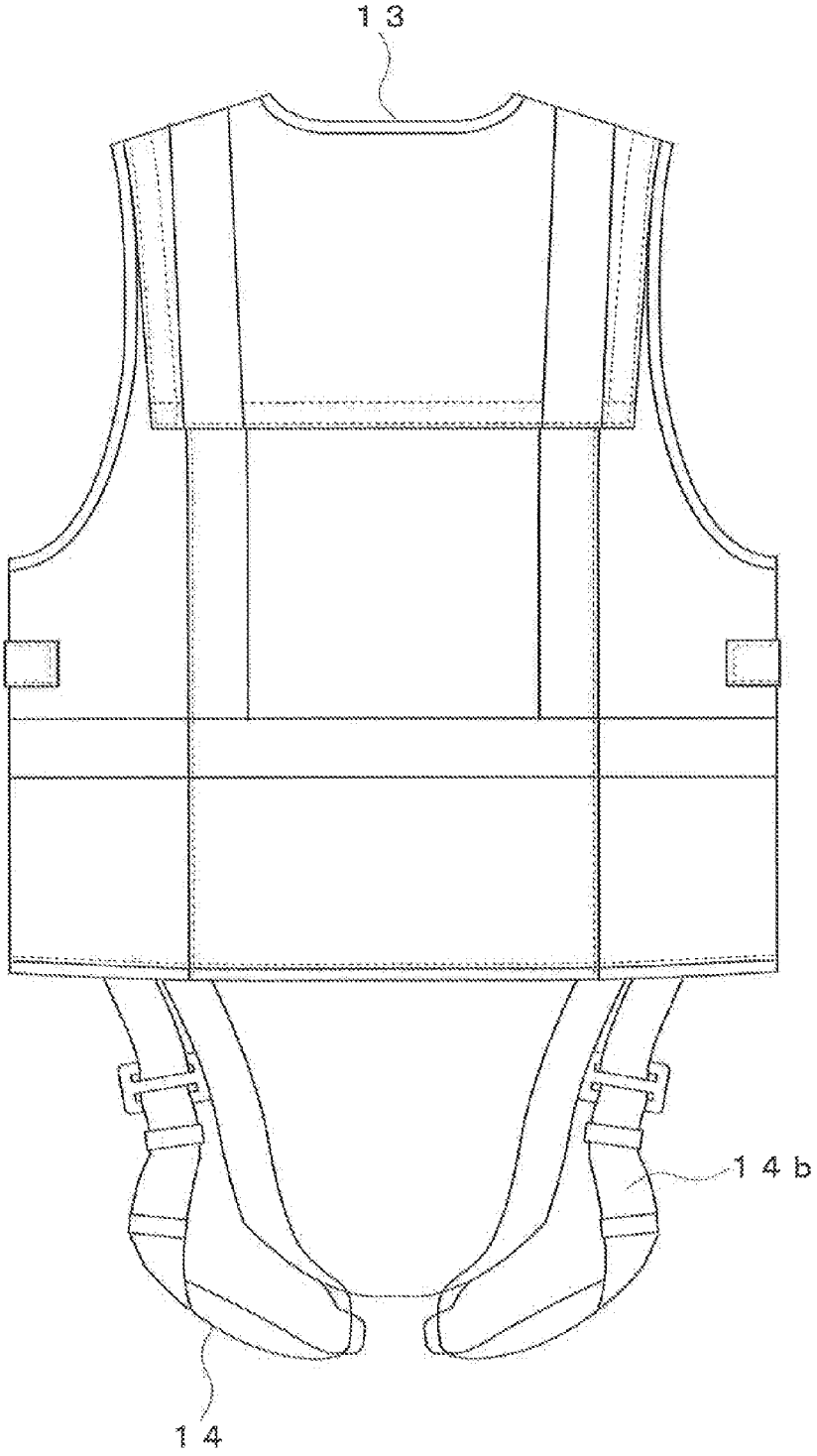
FIG. 27 is a rear view of the airbag device for the body.
Figure 28:
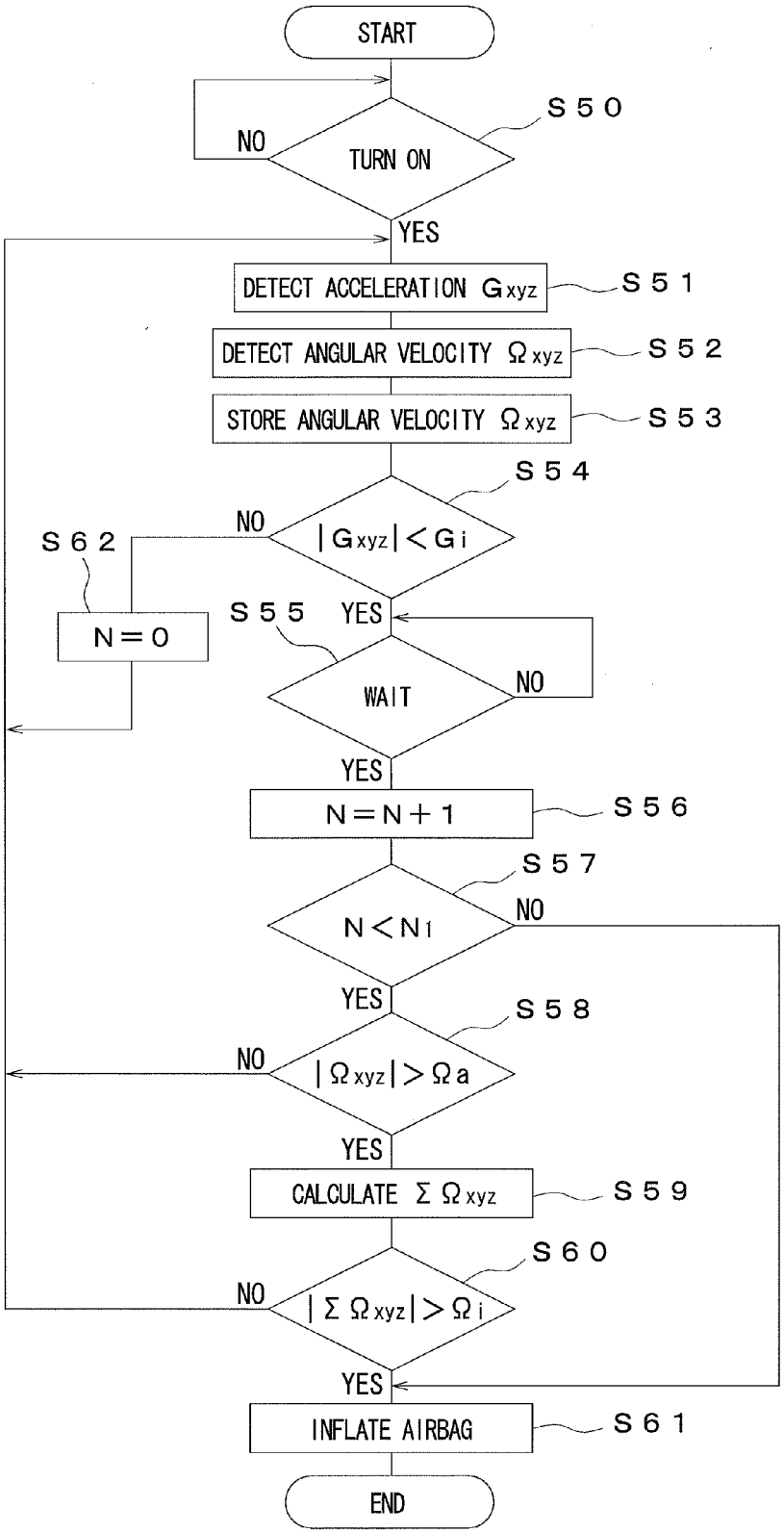
FIG. 28 is a flow chart showing an operation of a controller.

FIGS. 26 to 28 illustrate a fourth embodiment of the present invention and the same components as those described in the first embodiment are denoted by the same reference numerals.

An airbag device for the body according to this embodiment includes a garment 13 incorporating the airbag 1 and a harness-type safety belt 14 mounted on the garment 13, and the other components are same as those of the first embodiment.

As with the first embodiment, the garment 13 is formed into vest-type clothing wearable by the upper part of the body, and the back holds the airbag 1 in a deflated state. The inside of the garment 13 includes a plurality of fixing portions 13*a* to fix the harness-type safety belt 14. Each fixing portion 13*a* fixes a belt portion of the harness-type safety belt 14 by a hook and loop fastener, for example.

The harness-type safety belt 14 has a well-known configuration including an upper belt portion 14*a* worn by the upper part of the body and a lower belt portion 14*b* worn by the lower part of the body, and is used with a rope which is coupled with the upper belt portion 14*a* hooked on a main rope or the like at a work site. The upper belt portion 14*a* is installed in the inside of the garment 13 and is fixed on the garment 13 by each fixing portion 13*a*.

The airbag device for the body having such a configuration is used by the user's body wearing the garment 13 as well as the harness-type safety belt 14. When the user falls over or falls from a high place, the inflators 3 is activated to instantaneously inflate the airbag 1.

Now, referring to a flow chart of FIG. 28, an operation of the controller 7 will be described. First, when a main switch, not shown, is turned on (S50), the acceleration sensor 4 detects accelerations Gx, Gy, and Gz (S51), the angular velocity sensor 5 detects angular velocities Ωx, Ωy, and Ωz (S52), and the angular velocities Ωx, Ωy, and Ωz are stored in the memory 6 (S53). When a most recent angular velocity value is stored in the memory 6, an oldest angular velocity value is deleted from the memory 6. Then, if an absolute value |Gxyz| of each of the accelerations Gx, Gy, and Gz becomes smaller than a predetermined reference value Gi (S54), after a predetermined waiting time t (e.g., 0.01 seconds) (S55), "1" is added to a counter value N (initial value=0) (S56). Now, if the counter value N has not reached a predetermined set value N1 (S57) and an absolute value |Ωxyz| of any one of the angular velocities Ωx, Ωy, and Ωz is greater than a predetermined reference value Ωa (S58), values of integral ΣΩx, ΣΩy, and ΣΩz are calculated by integrating angular velocity values stored in the memory 9 from a most recent angular velocity to an oldest value within a predetermined time T (S59), and if an absolute value |ΣΩxyz| of any one of them is greater than a predetermined reference value Ωi (S60), it is determined that the body fell over, and the inflators 3 is activated to inflate the airbag 1 (S61). Also, in step S58, if each absolute value |Ωxyz| of the angular velocities Ωx, Ωy, and Ωz is equal to or smaller than the reference value Ωa, the processing returns to step S51 and the operation between step S51 and S58 is repeated. In this case, in step S54, if the absolute value |Gxyz| becomes equal to or greater than the predetermined reference value Gi, the counter value N is reset to "0" (S62). Also, in step S57, if the counter value N reaches the set value N1 (that is, the state "|Gxyz|<Gi" continues for a predetermined time period or longer), it is determined that the body fell in an upright posture, and the inflator 3 is activated to inflate the airbag 1 (S61).

Thus, according to this embodiment, even if each absolute value |Ωxyz| of the angular velocities Ωx, Ωy, and Ωz is equal to or smaller than the reference value Ωa, when a state in which an absolute value |Gxyz| of each of the accelerations Gx, Gy, and Gz is smaller than the predetermined reference value Gi continues for a predetermined time period or longer, the airbag 1 is inflated, so that the airbag 1 can be inflated even if the body falls without a tilt of the body caused by falling over, for example, in a case in which the body falls in an upright posture. Therefore, the airbag device for the body is extremely advantageous to protect the body from the impact caused by not only falling over but also a fall from a high place.

Also, since the garment 13 includes the harness-type safety belt 14, when those who work in high places such as construction sites wear the garments, the airbag devices can be used as the harness-type safety belts 14, so that the airbag device for the body is extremely advantageous for work at high places in which safety belts are needed to be used.

It should be noted that in the fourth embodiment, as with the first embodiment, the single airbag 1 is shown, but as with the third or the fourth embodiment, airbags corresponding to at least two of the anterior, the posterior, the right, and the left directions may be installed to inflate an airbag corresponding to a direction in which the body falls over.

Also, in the above-described embodiment, the harness-type safety belt 14 is installed in the garment 13 including the airbag 1, but a harness-type safety belt may include an airbag without a garment.

REFERENCE SIGNS LIST

1 . . . airbag, 2 . . . garment, 3 . . . inflator, 4 . . . acceleration sensor, 5 . . . angular velocity sensor, 6 . . . memory, 7 . . . controller, 9 . . . front airbag, 10. . . rear airbag, 11 . . . left airbag, 12 . . . right airbag, 13 . . . garment, 14 . . . harness-type safety belt, A . . . body.

The invention claimed is:

1. An airbag device for a body comprising:

an airbag mounted to cover a predetermined part of the body;

an inflating device for inflating the airbag;

an acceleration sensor for detecting an acceleration;

an angular velocity sensor for detecting an angular velocity;

an angular velocity storing device for storing angular velocity values detected by the angular velocity sensor; and a controlling device for, when an absolute value of an angular velocity detected by the angular velocity sensor becomes greater than a first predetermined value, integrating angular velocity values stored in the angular velocity storing device from a most recent detected value to an oldest value within a predetermined range, and for, if an absolute value of a resultant value of integral is greater than a second predetermined value and an absolute value of an acceleration detected by the acceleration sensor is smaller than a third predetermined value, inflating the airbag.

2. An airbag device for a body comprising:

an airbag mounted to cover a predetermined part of the body;

an inflating device for inflating the airbag;

an acceleration sensor for detecting an acceleration;

an angular velocity sensor for detecting an angular velocity;

an angular velocity storing device for storing angular velocity values detected by the angular velocity sensor; and a controlling device for, when an absolute value of an acceleration detected by the acceleration sensor continues to be smaller than a first predetermined value for a predetermined time period or longer, inflating the airbag or for, when an absolute value of an angular velocity detected by the angular velocity sensor becomes greater than a second predetermined value, integrating angular velocity values stored in the angular velocity storing device from a most recent detected value to an oldest value within a predetermined range, and for, if an absolute value of a resultant value of integral is greater than a third predetermined value, inflating the airbag.

3. The airbag device for the body according to claim 1, wherein the angular velocity storing device stores only angular velocity values from a most recent detected value to an oldest value within the predetermined range.

4. The airbag device for the body according to claim 1, wherein the airbag, the inflating device, and the angular velocity sensor are mounted to correspond to at least two of anterior, posterior, right, and left directions from the body, and wherein the controlling device inflates the airbag corresponding to a direction in which the absolute value of the resultant value of integral of the angular velocity values becomes greater than the second predetermined value.

5. The airbag device for the body according to claim 1, wherein as the acceleration sensor, an acceleration sensor that detects accelerations in at least three axial directions is adopted.

6. The airbag device for the body according to claim 1, wherein as the angular velocity sensor, an angular velocity sensor that detects angular velocities in at least three axial directions is adopted.

7. The airbag device for the body according to claim 1, further comprising a garment including the airbag and having a clothing form wearable by the body.

8. The airbag device for the body according to claim 7, wherein the garment includes a safety belt wearable by the body.

9. The airbag device for the body according to claim 1, further comprising a safety belt that includes the airbag and is wearable by the body.

10. The airbag device for the body according to claim 2, wherein the angular velocity storing device stores only angular velocity values from a most recent detected value to an oldest value within the predetermined range.

11. The airbag device for the body according to claim 2, wherein the airbag, the inflating device, and the angular velocity sensor are mounted to correspond to at least two of anterior, posterior, right, and left directions from the body, and wherein the controlling device inflates the airbag corresponding to a direction in which the absolute value of the resultant value of integral of the angular velocity values becomes greater than the third predetermined value.

12. The airbag device for the body according to claim 2, wherein as the acceleration sensor, an acceleration sensor that detects accelerations in at least three axial directions is adopted.

13. The airbag device for the body according to claim 2, wherein as the angular velocity sensor, an angular velocity sensor that detects angular velocities in at least three axial directions is adopted.

14. The airbag device for the body according to claim 2, further comprising a garment including the airbag and having a clothing form wearable by the body.

15. The airbag device for the body according to claim 14, wherein the garment includes a safety belt wearable by the body.

16. The airbag device for the body according to claim 2, further comprising a safety belt that includes the airbag and is wearable by the body.

* * * * *